US009873246B2

(12) United States Patent
Kato

(10) Patent No.: US 9,873,246 B2
(45) Date of Patent: Jan. 23, 2018

(54) PRINT DEVICE AND NON-TRANSITORY COMPUTER READABLE MEDIUM

(71) Applicant: BROTHER KOGYO KABUSHIKI KAISHA, Nagoya-shi, Aichi-ken (JP)

(72) Inventor: Yoshinori Kato, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/416,567

(22) Filed: Jan. 26, 2017

(65) Prior Publication Data

US 2017/0210126 A1 Jul. 27, 2017

(30) Foreign Application Priority Data

Jan. 26, 2016 (JP) ..... 2016-012884

(51) Int. Cl.

| | |
|---|---|
| ***B41J 29/393*** | (2006.01) |
| ***B41J 2/045*** | (2006.01) |
| ***B41J 2/175*** | (2006.01) |
| ***B41J 2/18*** | (2006.01) |

(52) U.S. Cl.

CPC ..... *B41J 2/04563* (2013.01); *B41J 2/175* (2013.01); *B41J 2/17596* (2013.01); *B41J 2/18* (2013.01)

(58) Field of Classification Search

CPC . B41J 2/04563; B41J 2/18; B41J 2/175; B41J 2/17596

See application file for complete search history.

(56) References Cited

U.S. PATENT DOCUMENTS

2007/0291075 A1* 12/2007 Mizoguchi ..... B41J 2/16532 347/37
2007/0291077 A1* 12/2007 Seki ..... B41J 2/175 347/37
2010/0141694 A1* 6/2010 Kurasawa ..... B41J 2/17509 347/6
2014/0132653 A1 5/2014 Kamiyama
(Continued)

FOREIGN PATENT DOCUMENTS

EP 1867483 A1 12/2007
EP 2505361 A1 10/2012
(Continued)

OTHER PUBLICATIONS

Extended European Search Report dated Jun. 8, 2017 issued in the corresponding European Patent Application No. 17153099.1.

*Primary Examiner* — Julian Huffman
(74) *Attorney, Agent, or Firm* — K&L Gates LLP

(57) ABSTRACT

When a processor of a print device determines that an elapsed time since a circulation operation of a liquid is not less than a fixed time and does not determine that the elapsed time is not less than a first time, the processor performs a first circulation operation that circulates the liquid in a state in which a supply flow path and a circulation flow path are not open to the atmosphere. When the processor determines that the elapsed time is not less than the fixed time, is not less than the first time, and is less than a second time, the processor performs a second circulation operation that agitates the liquid more than the first circulation operation does. Therefore, the print device is able to agitate the liquid in accordance with the time that has elapsed since the circulation operation was last performed.

10 Claims, 15 Drawing Sheets

(56) References Cited

U.S. PATENT DOCUMENTS

| | | | | |
|---|---|---|---|---|
| 2014/0168295 | A1 | 6/2014 | Ichihara et al. | |
| 2016/0167393 | A1* | 6/2016 | Watanabe | B41J 2/17513 347/85 |

FOREIGN PATENT DOCUMENTS

| | | | |
|---|---|---|---|
| EP | 2572885 | A1 | 3/2013 |
| JP | H11188894 | A | 7/1999 |
| JP | 2014117898 | A | 6/2014 |
| JP | 2015-100988 | A | 6/2015 |

* cited by examiner

UP
DOWN
200
100
700
706
706
905
906
901
902
90
8
81
821 (80)
823 (80)
811 (80)
311 (3)
321 (3)
323 (3)
731
732
685
686
682
681
754A
753A
611
702A
701A
703A
623
621
82
835
833
831
755A
741
743
712
711
71A
696
661
676
672
671
673
120
122
121
123
124
30
110
111
113
97
W2
W3
401 (40)
402 (40)
756A
757A
761A
761
762
762A
662
761C
762C
773A
773
772
771
781
782
783
791
792
784
785
786
775
776
777
778
774
721
723
67
767
767A
767C
765
765A
765C
777A
513 (51)
511 (51)

PRINT DEVICE AND NON-TRANSITORY COMPUTER READABLE MEDIUM

CROSS-REFERENCE TO RELATED APPLICATION

This application claims priority to Japanese Patent Application No. 2016-012884 filed on Jan. 26, 2016, the disclosure of which is herein incorporated by reference in its entirety.

BACKGROUND

The present disclosure relates to a print device and a non-transitory computer readable medium.

An inkjet printer is known that inhibits decreases in image quality by agitating a pigmented ink. For example, Japanese Laid-Open Patent Publication No. 2015-100988 discloses an inkjet printer that operates a pump to move a pigmented ink that is contained in a container and performs an agitation operation that agitates the pigmented ink.

SUMMARY

When the agitation operation is performed, in order for the inkjet printer to move the pigmented ink, atmospheric pressure is maintained in the interior of the container by a through-hole that connects the interior of the container to the atmosphere. Because the interior of the container is open to the atmosphere, the pigmented ink that is contained in the container tends to dry out. It is also possible for dust and the like to get into the container through the through-hole. The possibility therefore exists that the performance of a head that discharges the pigmented ink will be adversely affected.

If a circulation flow path is not open to the atmosphere, the pressure of the ink that moves through the circulation flow path tends to become less than the atmospheric pressure. It therefore becomes difficult to maintain a meniscus that is formed in a nozzle. The pressure of the ink is related to the viscosity of the ink, and the viscosity of the ink is related to the temperature. A problem therefore occurs in which, when the circulation flow path is not open to the atmosphere, the pressure of the ink is readily affected by changes in temperature.

Embodiments of the broad principles derived herein provide a print device and a non-transitory computer readable medium that are able to reduce the possibility that decreases in print quality will occur.

The embodiments herein provide a print device of the present invention includes a head, a storage portion, a supply flow path, a circulation flow path, a circulation portion, a processor, and a memory. The head is provided with a nozzle that discharges a liquid. The storage portion stores the liquid. The supply flow path is connected to the head and the storage portion, and it supplies the liquid to the head from the storage portion. One end of the circulation flow path is connected to one of the storage portion and the supply flow path at a first connection portion, and the other end of the circulation flow path is connected to one of the head and the supply flow path at a second connection portion. The position of the second connection portion in the supply flow path is closer to the head than is the position of the first connection portion in the supply flow path. The circulation portion circulates the liquid through the supply flow path and the circulation flow path. The memory stores computer readable instructions that, when executed by the processor, perform processes, including first determination processing, first circulation processing, and second circulation processing. The first determination processing determines whether a first time has elapsed since a circulation operation was last performed. When the first determination processing has determined that the first time has not elapsed, the first circulation processing causes a first circulation operation to circulate the liquid in a sealed state, in the sealed state the supply flow path and the circulation flow path are not open to the atmosphere. When the first determination processing has determined that the first time has elapsed, the second circulation processing performs a second circulation operation, the second circulation operation agitates the liquid more than does the first circulation operation, in the sealed state. When the processor has determined, in the first determination processing, that the first time has not elapsed since the circulation operation was last performed, the processor performs the first circulation processing in the sealed state. If the time that has elapsed since the circulation operation was last performed is not less than the first time, sedimentation of components of the liquid advances, but the processor, in the second circulation processing, performs the second circulation operation, the second circulation operation agitates the liquid more than does the first circulation operation, in the sealed state. Therefore, the sedimentation of the components that are contained in the liquid can be reduced. The supply flow path and the circulation flow path are not open to the atmosphere, so the liquid in the supply flow path and the circulation flow path can be prevented from drying out, and dust and the like can be prevented from entering the supply flow path and the circulation flow path. The possibility that a drop in the printing quality will occur can therefore be reduced.

The embodiments herein also provide a print device includes a head, a storage portion, a supply flow path, a circulation flow path, a circulation portion, a processor, and a memory. The head is provided with a nozzle that discharges a liquid. The storage portion stores the liquid. The supply flow path is connected to the head and the storage portion, and it supplies the liquid to the head from the storage portion. One end of the circulation flow path is connected to one of the storage portion and the supply flow path at a first connection portion, and the other end of the circulation flow path is connected to one of the head and the supply flow path at a second connection portion. The position of the second connection portion in the supply flow path is closer to the head than is the position of the first connection portion in the supply flow path. The circulation portion circulates the liquid through the supply flow path and the circulation flow path. The memory stores computer readable instructions that, when executed by the processor, perform processes, including first acquisition processing, second acquisition processing, and operation processing. The first acquisition processing acquires an elapsed time since a circulation operation was last performed. The second acquisition processing acquires an operation time in accordance with the elapsed time that was acquired by the first acquisition processing. The operation processing operates the circulation portion in a sealed state, in the sealed state the supply flow path and the circulation flow path are not open to the atmosphere, for the operation time that was acquired by the second acquisition processing. Therefore, a control portion is not required to perform a plurality of determinations of the elapsed time, and the processing becomes simpler.

The embodiments herein also provide a non-transitory computer readable medium stores computer readable instructions that, when executed by a processor of a print device, perform processes, including first determination processing, first circulation processing, and second circulation processing. The print device is provided with a head, a storage portion, a supply flow path, a circulation flow path, a circulation portion, and the processor. The head is provided with a nozzle that discharges a liquid. The storage portion stores the liquid. The supply flow path is connected to the head and the storage portion, and it supplies the liquid to the head from the storage portion. One end of the circulation flow path is connected to one of the storage portion and the supply flow path at a first connection portion, and the other end of the circulation flow path is connected to one of the head and the supply flow path at a second connection portion. The position of the second connection portion in the supply flow path is closer to the head than is the position of the first connection portion in the supply flow path. The circulation portion circulates the liquid through the supply flow path and the circulation flow path. The processor is configured to control the circulation portion. The first determination processing determines whether a first time has elapsed since a circulation operation was last performed. When the first determination processing has determined that the first time has not elapsed, the first circulation processing causes a first circulation operation to circulate the liquid in a sealed state, in which the supply flow path and the circulation flow path are not open to the atmosphere. When the first determination processing has determined that the first time has elapsed, the second circulation processing performs a second circulation operation, that agitates the liquid more than does the first circulation operation, in the sealed state.

BRIEF DESCRIPTION OF THE DRAWINGS

Embodiments will be described below in detail with reference to the accompanying drawings in which.

DETAILED DESCRIPTION

Figure 1:
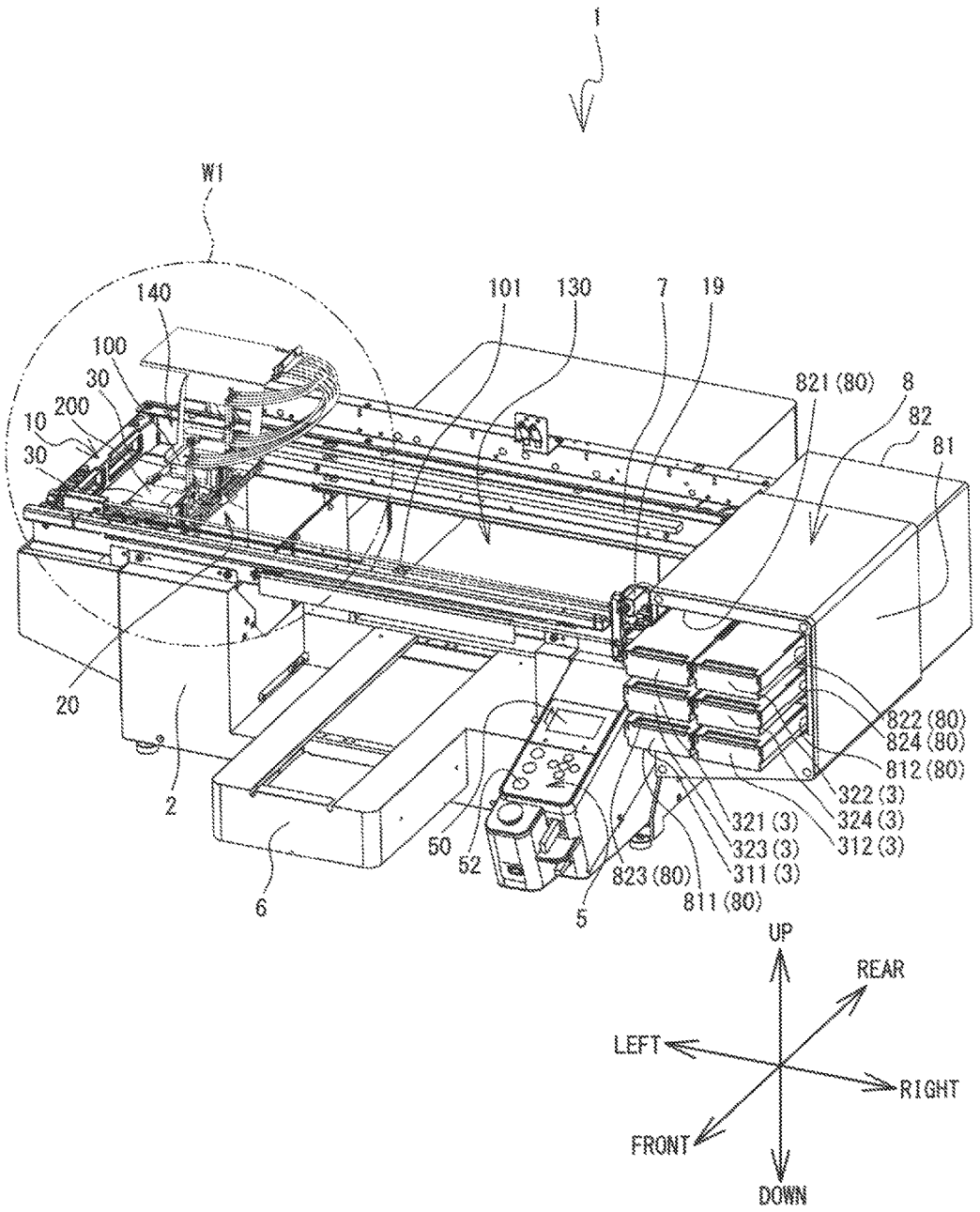
FIG. 1 is an oblique view of a printer.

The overall configuration of a printer 1 will be explained with reference to FIGS. 1 to 5. In the explanation that follows, the terms left, right, front, rear, up, and down that are used are those indicated by the arrows in the drawings.

As shown in FIG. 1, the printer 1 is an inkjet printer that prints by discharging an ink that is an example of a liquid onto a cloth such as a T-shirt or the like that is a printing medium (not shown in the drawings). The printing medium may also be a paper or the like. The printer 1 can print a color image on the printing medium by discharging downward five different types of the ink (white, black, yellow, cyan, and magenta), for example. In the explanation that follows, among the five different types of the ink, the ink that is white will be called the white ink. The other four types of the ink, black, cyan, yellow, and magenta, will be collectively called the color inks. When the white ink and the color inks are referenced collectively, as well as when no one ink is specified, they will be called simply "the ink".

When the color of the printing medium is mainly a dark color, the printer 1 prints by discharging the white ink as a base coat over all or a portion of the printing area. The printer 1 discharges the color inks after it has discharged the white ink. The white ink is a liquid that contains components that are more prone to sedimentation than are the components that the color inks contain. The components that are prone to sedimentation are white pigment particles, and they tend to settle out. Titanium oxide is an example of a component that is prone to sedimentation. Titanium oxide is an inorganic pigment with a comparatively high specific gravity. Therefore, when the printer 1 prints using the white ink, it is necessary to maintain the good flowability of the white ink by keeping the white ink sufficiently agitated in the white ink flow path.

Figure 2:
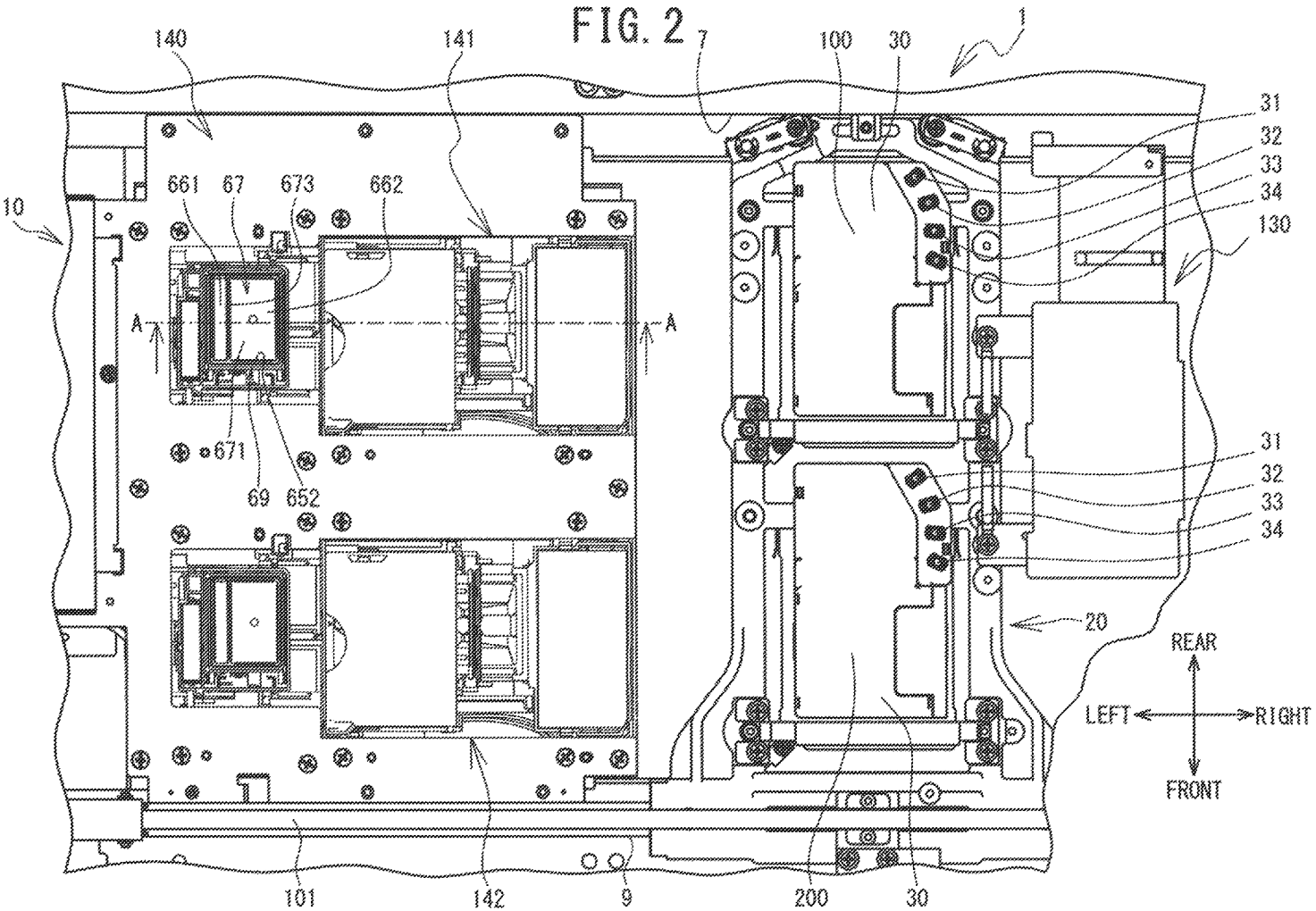
FIG. 2 is a plan view of the printer.
Figure 3:
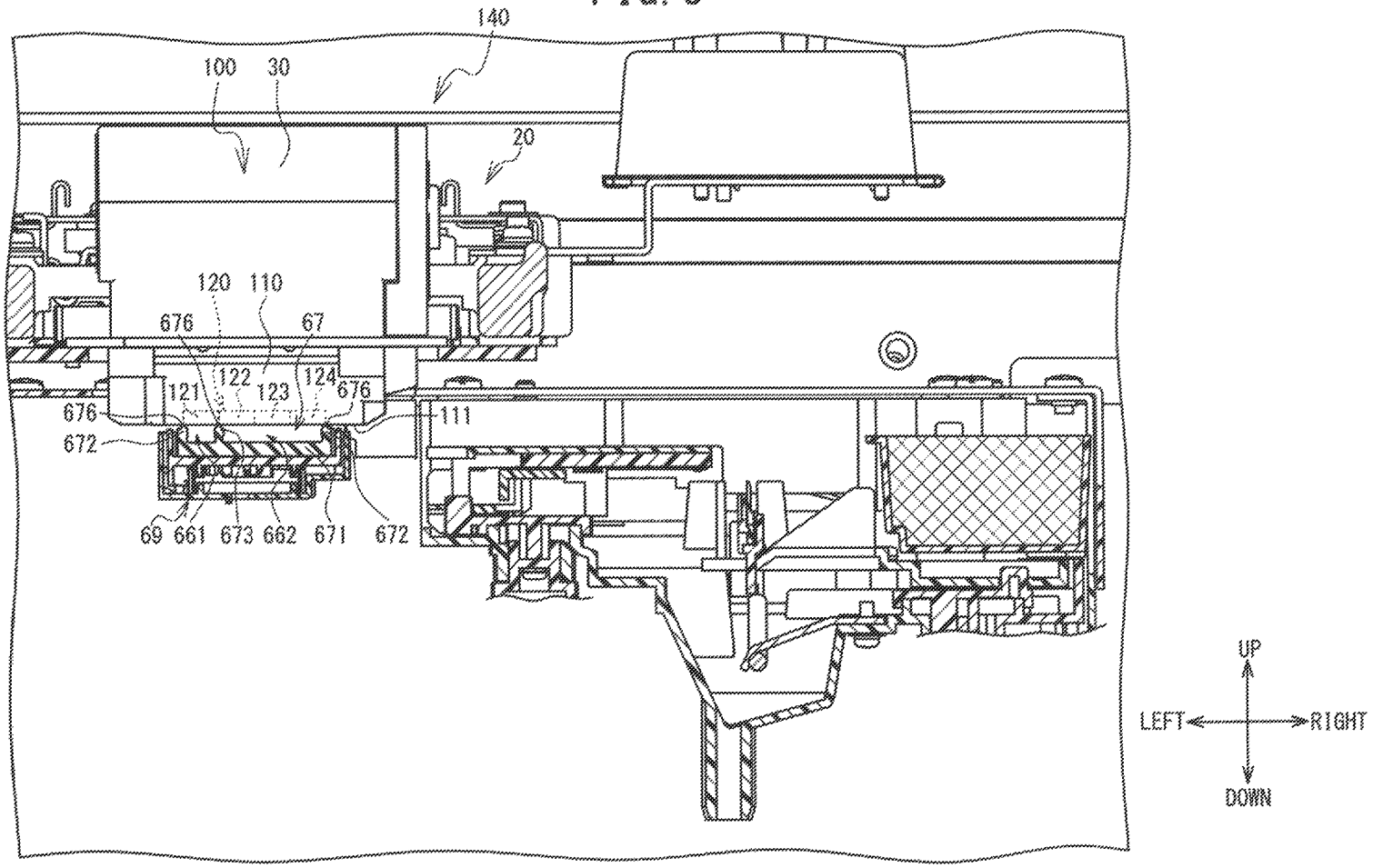
FIG. 3 is a section view of a head unit, as seen from the direction of arrows A-A in FIG. 2, when the head unit has moved to a position above a cap.

As shown in FIGS. 1 to 3, the printer 1 is provided with a housing 2, a frame body 10, a shaft 9, a rail 7, a carriage 20, head units 100, 200, a drive belt 101, a drive motor 19, a platen drive mechanism 6, a mounting frame portion 8, and, in a non-printing area 140, maintenance portions 141, 142.

An operation portion 5 of the printer 1 is located on the right front side of the housing 2. The operation portion 5 is provided with a display 50 and operation buttons 52. An operator operates the operation buttons 52 when inputting commands that pertain to various operations of the printer 1.

The top portion of the housing 2 holds the frame body 10, which is substantially rectangular in a plan view. The front side of the frame body 10 supports the shaft 9 (refer to FIG. 2). The rear side of the frame body 10 supports the rail 7. The shaft 9 extends from left to right on the inner side of the frame body 10. The rail 7 is disposed opposite the guide shaft 9 and extends from left to right.

Figure 4:
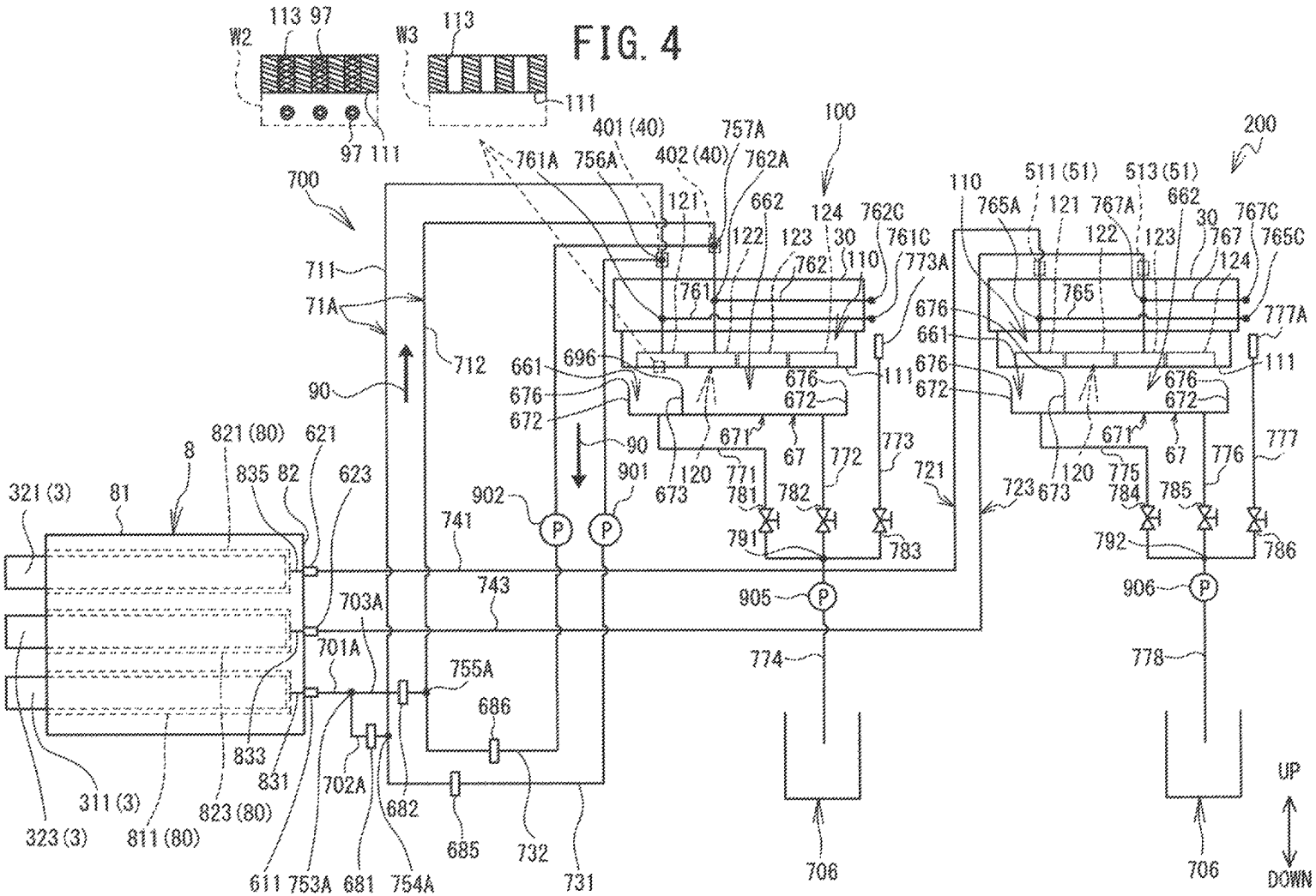
FIG. 4 is a schematic drawing that shows a portion of an ink flow path system.
Figure 5:
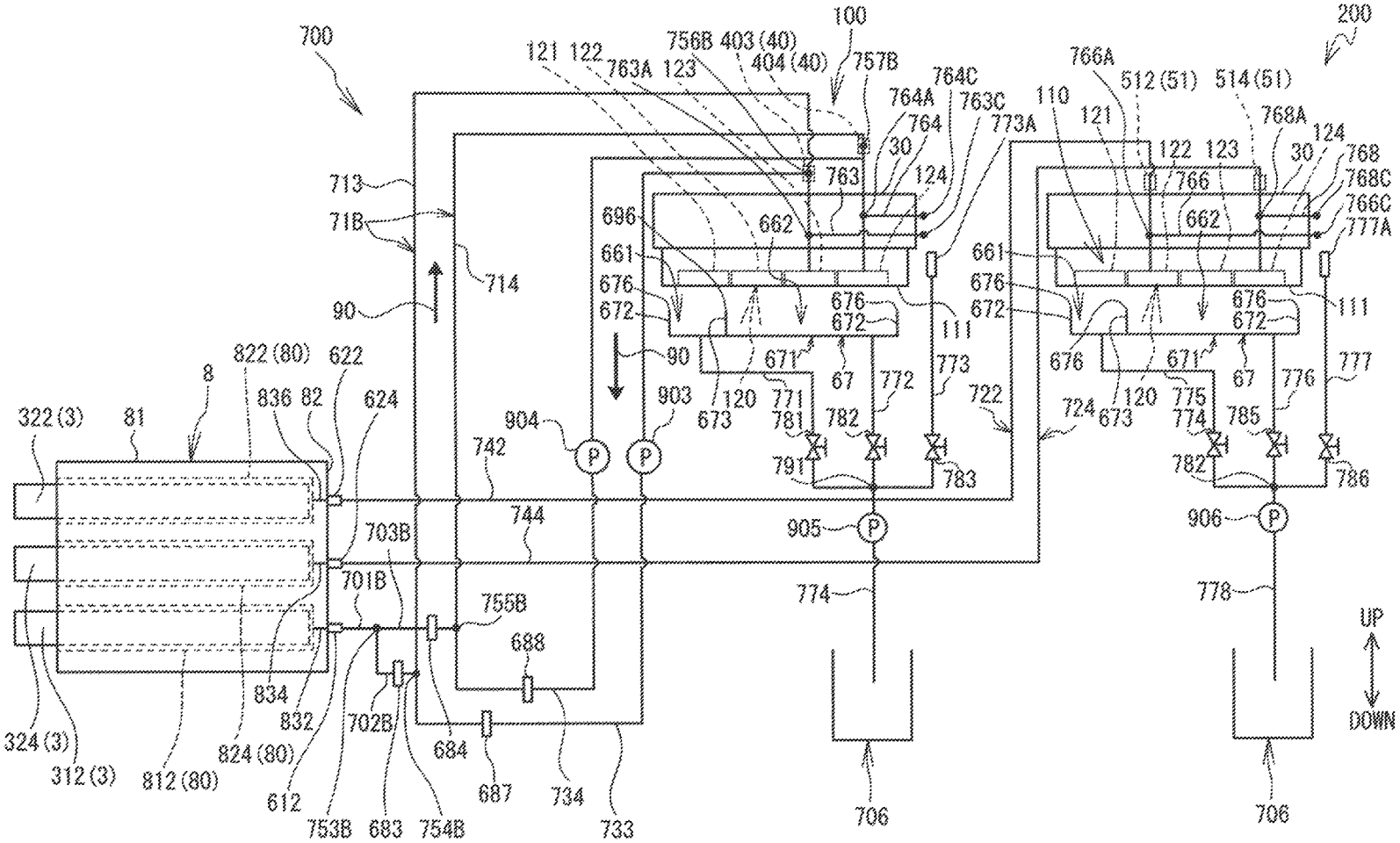
FIG. 5 is a schematic drawing that shows another portion of the ink flow path system.

The carriage 20 can be conveyed to the left and the right along the shaft 9. As shown in FIGS. 1 and 2, the head units 100, 200 are carried on the carriage 20 and are arrayed in the front-rear direction. The head unit 100 is disposed to the rear of the head unit 200. As shown in FIGS. 1 to 3, the head units 100, 200 are each provided with a housing 30. As shown in FIG. 3, the bottom portion of the housing 30 of the head unit 100 supports a head 110. The bottom portion of the head unit 200 is configured in the same manner as that of the head unit 100. FIGS. 4 and 5 show the positions, in the up-down direction, of various members that configure the ink flow paths in the interior of the printer 1. FIGS. 4 and 5 show the head units 100, 200, as seen from the front, arrayed left to right on the page. The head 110 of the head unit 100 discharges the white ink. The head 110 of the head unit 200 discharges the color inks.

The head 110 is provided with a nozzle face 111 (refer to FIG. 3). The nozzle face 111 is a face that has a plurality of tiny nozzles 113 (refer to FIG. 4) that are capable of discharging the inks downward. The nozzle face 111 is a flat surface that extends in the left-right direction and the front-rear direction. The head units 100, 200 each have the nozzle face 111 on their bottom faces. The plurality of the nozzles 113 in the nozzle face 111 are disposed in a nozzle disposition area 120. The nozzle disposition area 120 is disposed in the center of the left-right direction of the nozzle face 111. The nozzle disposition area 120 extends in the front-rear direction.

As shown in FIG. 3, the nozzle face 111 has nozzle arrays 121 to 124. Each one of the nozzle arrays 121 to 124 is an array of a plurality of the nozzles 113. The nozzle arrays 121 to 124 are disposed in four separate areas in the left-right direction of the nozzle disposition area 120. The nozzle arrays 121 to 124 are arrayed as the nozzle array 121, the nozzle array 122, the nozzle array 123, and the nozzle array 124, in that order from left to right.

As shown in FIGS. 4 and 5, the nozzle arrays 121, 122 of the head unit 100 are connected to a single cartridge 311 (refer to FIGS. 1 and 4), which stores the white ink. The nozzle arrays 123, 124 are connected to another single cartridge 312 (refer to FIGS. 1 and 5), which stores the white ink.

The nozzle arrays 121 to 124 of the head unit 200 can respectively be connected to cartridges 321 to 324, which store the color inks. In the head unit 200, the nozzle array 121 is connected to the black ink cartridge 321 (refer to FIGS. 1 and 4). The nozzle array 122 is connected to the yellow ink cartridge 322 (refer to FIGS. 1 and 5). The nozzle array 123 is connected to the cyan ink cartridge 323 (refer to FIGS. 1 and 4). The nozzle array 124 is connected to the magenta ink cartridge 324 (refer to FIGS. 1 and 5).

As shown in FIG. 1, the drive belt 101 spans the inner side of the frame body 10 in the left-right direction. The drive motor 19 is coupled to the carriage 20 through the drive belt 101. As the drive motor 19 drives the drive belt 101, the carriage 20 moves reciprocally to the left and the right along the shaft 9.

The platen drive mechanism 6 is provided with a pair of guide rails (not shown in the drawings) and a platen (not shown in the drawings). The pair of the guide rails extend in the front-rear direction on the inner side of the platen drive mechanism 6 and support the platen. The platen is able to move toward the front and the rear along the pair of the guide rails. The platen has a plate shape that is substantially rectangular in a plan view, with its long axis extending in the front-rear direction. The platen is disposed below the frame body 10. The top portion of the platen holds the printing medium. The platen drive mechanism 6 moves the platen toward the front and the rear, with a motor (not shown in the drawings) serving as the drive source. The platen therefore conveys the printing medium in the front-rear direction (an sub-scanning direction). The head 110, which moves in the left-right direction (a main-scanning direction), performs printing on the printing medium by discharging the inks.

As shown in FIG. 1, the mounting frame portion 8 is disposed on the right side of the housing 2. A housing 81 that supports the mounting frame portion 8 has a substantially three-dimensional rectangular shape, with its long axis extending in the front-rear direction. The mounting frame portion 8 is provided with a plurality of mounting portions 80, in which a plurality of cartridges 3 (311, 312, 321, 322, 323, and 324) can be mounted. Each one of the mounting portions 80 is a recessed portion that is recessed toward the rear from the front face of the mounting frame portion 8. Draw-out needles 831 to 836 (refer to FIGS. 4 and 5), which have hollow needle shapes, are provided on the inner side of the rear ends of the plurality of the mounting portions 80. When the cartridges 3 are mounted in the mounting portions 80, the draw-out needles 831 to 836 pierce rubber plugs (not shown in the drawings) in ink containing bodies (not shown in the drawings) that are contained in the cartridges 3. The inks that the draw-out needles 831 to 836 draw out flow to the heads 110.

As shown in FIGS. 1, 4, and 5, the plurality of the mounting portions 80 are provided with upper mounting portions 821 to 824 and lower mounting portions 811, 812. The upper mounting portions 821 to 824 are located in the upper portion of the mounting frame portion 8. The lower mounting portions 811, 812 are positioned lower than the upper mounting portions 821 to 824. The cartridges 311, 312, which contain the white ink, can be mounted in the lower mounting portions 811, 812, respectively. The cartridges 321 to 324, which contain the color inks, can be mounted in the upper mounting portions 821 to 824, respectively.

As shown in FIGS. 1 and 2, along the paths that the head units 100, 200 travel, the area where the head units 100, 200 perform the printing is called a printing area 130. The area along the paths that the head units 100, 200 travel that is not in the printing area 130 is the non-printing area 140. The non-printing area 140 is an area in the left end portion of the printer 1. The printing area 130 is the area from the right edge of the non-printing area 140 to the right end of the printer 1. The platen is disposed in the printing area 130, below the paths that the head units 100, 200 travel.

As shown in FIG. 2, the maintenance portions 141, 142 are disposed in the non-printing area 140, below the travel paths of the head units 100, 200, respectively. Maintenance operations such as purging and the like, are performed by the maintenance portions 141, 142 in order to restore the ink discharge performance of the head units 100, 200 and ensure the printing quality of the printer 1.

As shown in FIGS. 2 and 3, the maintenance portion 141 is provided with a cap 67 and the like. The cap 67 is located in the left portion of the maintenance portion 141. The cap 67 is made of a synthetic resin such as silicon rubber or the like, for example, and it is provided with a bottom wall 671, a perimeter wall 672, and a partition wall 673. The partition wall 673 divides the area inside the partition wall 673 into two parts. In the explanation that follows, the area inside the partition wall 673 that is to the left of the partition wall 673 will be called the first area 661. The area that is to the right of the partition wall 673 will be called the second area 662. The cap 67 is moved up and down by operation of a motor, a gear, and the like that are not shown in the drawings. As shown in FIG. 3, when the head unit 100 has moved into the non-printing area 140 and the cap 67 has moved upward, an upper edge 676 of the perimeter wall 672 seals the perimeter of the nozzle disposition area 120 of the nozzle face 111 of the head unit 100. The cap 67 therefore covers the plurality of the nozzles 113. An upper edge 676 of the partition wall 673 seals the boundary between the nozzle array 121 and the nozzle arrays 122 to 124. In the explanation that follows, when the cap 67 is sealing the nozzle face 111, the position of the cap 67 and a cap support portion 69 will be called the covering position. When the cap 67 is not sealing the nozzle face 111, the position of the cap 67 and the cap support portion 69 will be called the cap withdrawn position.

An ink flow path system 700 will be explained with reference to FIGS. 4 and 5. In order to make the drawings easy to understand, FIGS. 4 and 5 shows the ink flow path system 700, the heads 110, and the caps 67 schematically. As shown in FIGS. 4 and 5, the ink flow path system 700 is provided with first flow paths 71A, 71B and second flow paths 721 to 724. FIG. 4 shows the flow paths that are connected to the lower mounting portion 811 and the upper mounting portions 821, 823 (refer to FIG. 1). FIG. 5 shows the flow paths that are connected to the lower mounting portion 812 and the upper mounting portions 822, 824 (refer to FIG. 1).

The first flow paths 71A, 71B are flow paths that connect the lower mounting portions 811, 812, respectively, to the head 110 of the head unit 100. The first flow paths 71A, 71B are the flow paths through which the white ink flows. The second flow paths 721 to 724 are flow paths that connect the upper mounting portions 821 to 824, respectively, to the head 110 of the head unit 200. The second flow paths 721 to 724 are the flow paths through which the color inks flow.

As shown in FIG. 4, the first flow path 71A is provided with the draw-out needle 831, an ink supply outlet 611, a draw-out flow path 701A, connecting flow paths 702A, 703A, a branching portion 753A, connection portions 754A, 755A, first supply flow paths 711, 712, circulation flow paths 731, 732, connection portions 761A, 762A, drain flow paths 761, 762, drain outlets 761C, 762C, filter portions 685, 686, and pumps 901, 902. The draw-out flow path 701A, the connecting flow paths 702A, 703A, the first supply flow paths 711, 712, and the circulation flow paths 731, 732 are configured from tubes.

The ink supply outlet 611 is located in the mounting frame portion 8. The draw-out needle 831 is located in the lower mounting portion 811. The ink supply outlet 611 supplies the white ink that the draw-out needle 831 draws out to the draw-out flow path 701A. The draw-out flow path 701A is the flow path that is connected to the ink supply outlet 611.

The branching portion 753A is located at the end of the draw-out flow path 701A that is closer to the head 110. The branching portion 753A connects the draw-out flow path 701A to one end of each of two flow paths, the connecting flow path 702A and the connecting flow path 703A. The connection portions 754A, 755A respectively connect the other ends of the connecting flow paths 702A, 703A to the first supply flow paths 711, 712, respectively.

The first supply flow paths 711, 712 are respectively connected to the nozzle arrays 121, 122 of the head unit 100, and they supply to the head 110 of the head unit 100 the white ink that flows through the draw-out flow path 701A and the connecting flow paths 702A, 703A.

The circulation flow path 731 is connected to the first supply flow path 711 at a connection portion 756A, which is located outside the head unit 100. The circulation flow path 732 is connected to the first supply flow path 712 at a connection portion 757A, which is located outside the head unit 100. The opposite ends of the circulation flow paths 731, 732 from the connection portions 756A, 757A, that is, the ends that are closer to the respective mounting portions 80, are respectively connected to the first supply flow paths 711, 712 at the connection portions 754A, 755A, respectively. Therefore, in a circulation operation, the white ink circulates through the first supply flow paths 711, 712 and the circulation flow paths 731, 732 without circulating inside the head 110. The printer 1 therefore performs outside-the-head circulation (inside-the-supply-path circulation) of the white ink. The circulation flow path 731 is provided with the pump 901 and the filter portion 685. The circulation flow path 732 is provided with the pump 902 and the filter portion 686. In subsequent descriptions, the first supply flow paths 711, 712 and the circulation flow paths 731, 732 are sometimes described as the circulation flow paths.

The drain flow path 761 is connected to the first supply flow path 711 at the connection portion 761A, which is located in the first supply flow path 711 between the connection portion 756A and the nozzle array 121. The drain flow path 762 is connected to the first supply flow path 712 at the connection portion 762A, which is located in the first supply flow path 712 between the connection portion 757A and the nozzle array 122. The connection portions 761A, 762A are located in the interior of the head unit 100. The drain flow paths 761, 762 respectively extend from the connection portions 761A, 762A to the outside of the head unit 100 without passing through the nozzle arrays 121, 122. The drain outlets 761C, 762C are located on the outside ends of the drain flow paths 761, 762, respectively.

As shown in FIG. 5, the first flow path 71B is provided with the draw-out needle 832, an ink supply outlet 612, a draw-out flow path 701B, connecting flow paths 702B, 703B, a branching portion 753B, connection portions 754B, 755B, first supply flow paths 713, 714, circulation flow paths 733, 734, drain flow paths 763, 764, drain outlets 763C, 764C, filter portions 687, 688, and pumps 903, 904. The draw-out flow path 701B, the connecting flow paths 702B, 703B, the first supply flow paths 713, 714, and the circulation flow paths 733, 734 are configured from tubes.

The ink supply outlet 612 is located in the mounting frame portion 8. The draw-out needle 832 is located in the lower mounting portion 812. The ink supply outlet 612 supplies the white ink that the draw-out needle 832 draws out to the draw-out flow path 701B. The draw-out flow path 701B is the flow path that is connected to the ink supply outlet 612.

The branching portion 753B is located at the end of the draw-out flow path 701B that is closer to the head 110. The branching portion 753B connects the draw-out flow path 701B to one end of each of two flow paths, the connecting flow path 702B and the connecting flow path 703B. The connection portions 754B, 755B respectively connect the other ends of the connecting flow paths 702B, 703B to the first supply flow paths 713, 714, respectively.

The first supply flow paths 713, 714 are respectively connected to the nozzle arrays 123, 124 of the head unit 100, and they supply to the head 110 the white ink that flows through the draw-out flow path 701B and the connecting flow paths 702B, 703B.

The circulation flow path 733 is connected to the first supply flow path 713 at a connection portion 756B, which is located outside the head unit 100. The circulation flow path 734 is connected to the first supply flow path 714 at a connection portion 757B, which is located outside the head unit 100. The opposite ends of the circulation flow paths 733, 734 from the connection portions 756B, 757B, that is, the ends that are closer to the respective mounting portions 80, are respectively connected to the first supply flow paths 713, 714 at the connection portions 754B, 755B, respectively. The circulation flow path 733 is provided with the pump 903 and the filter portion 687. Therefore, in the circulation operation, the white ink circulates through the first supply flow paths 713, 714 and the circulation flow paths 733, 734 without circulating inside the head 110. The printer 1 therefore performs outside-the-head circulation (inside-the-supply-path circulation) of the white ink. The circulation flow path 734 is provided with the pump 904 and the filter portion 688. In subsequent descriptions, the first supply flow paths 713, 714 and the circulation flow paths 733, 734 are sometimes described as the circulation flow paths.

The drain flow path 763 is connected to the first supply flow path 713 at the connection portion 763A, which is located in the first supply flow path 713 between the connection portion 756B and the nozzle array 123. The drain flow path 764 is connected to the first supply flow path 714 at the connection portion 764A, which is located in the first supply flow path 714 between the connection portion 757B and the nozzle array 124. The connection portions 763A, 764A are located in the interior of the head unit 100. The drain flow paths 763, 764 respectively extend from the connection portions 763A, 764A to the outside of the head unit 100 without passing through the nozzle arrays 123, 124. The drain outlets 763C, 764C are located on the outside ends of the drain flow paths 763, 764, respectively.

Circulation Operation

The printer 1 performs a circulation operation that will be described later by operating the pumps 901 to 904 to generate negative pressure in the circulation flow paths 731 to 734. When the printer 1 performs the circulation operation, the white ink circulates within the first flow paths 71A, 71B, as indicated by the arrows 90 in FIGS. 4 and 5. The white ink is thus agitated in the first flow paths 71A, 71B. The printer 1 performs the circulation operation while the printing operation is not being performed and the heads 110 of the head units 100, 200 are not discharging the inks. Therefore, when the printing operation is being performed, the white ink does not circulate in the circulation flow paths 731 to 734 in the directions indicated by the arrows 90.

The second flow paths 721 to 724, through which the color inks flow, will be explained. As shown in FIGS. 4 and 5, the second flow paths 721 to 724 are flow paths that connect the upper mounting portions 821 to 824, respectively, to the head 110 of the head unit 200. The second flow paths 721 to 724 are provided with the draw-out needles 835, 836, 833, 834, ink supply outlets 621 to 624, second supply flow paths 741 to 744, connection portions 765A, 766A, 767A, 768A, drain flow paths 765 to 768, and drain outlets 765C, 766C, 767C, 768C. The second flow paths 721 to 724 are not provided with structures that are equivalent to the branching portions 753A, 753B, the connecting flow paths 702A, 703A, 702B, 703B, and the circulation flow paths 731 to 734 of the first flow paths 71A, 71B. Therefore, the second flow paths 721 to 724 are also not provided with structures that are equivalent to the filter portions 681 to 688 and the pumps 901 to 904, which are located in the connecting flow paths 702A, 703A, 702B, 703B and the circulation flow paths 731 to 734 of the first flow paths 71A, 71B. The other structures in the second flow paths 721 to 724 are the same as those in the first flow paths 71A, 71B.

As shown in FIGS. 4 and 5, the first flow paths 71A, 71B and the second flow paths 721 to 724 can be connected to waste liquid flow paths 771 to 778, waste liquid on-off valves 781 to 786, pumps 905, 906, and a waste liquid tank 706 through the cap 67 and connection portions 773A, 777A. An example will be explained below.

The cap 67 is able to cover the head 110 of the head unit 100. The waste liquid flow paths 771, 772 are respectively connected to the first area 661 and the second area 662 of the cap 67. At its upstream end, the waste liquid flow path 773 is provided with the connection portion 773A, which is able to connect to the drain outlets 761C to 764C. The waste liquid flow paths 771 to 773 converge at a convergence portion 791 and are connected to the waste liquid tank 706 through the pump 905. The waste liquid tank 706 is a container that stores, outside of the ink flow path system 700, the ink that has flowed out from the cap 67 and the drain outlets 761C to 764C. The pump 905 sucks up the white ink from the cap 67 and the drain outlets 761C to 764C through the waste liquid flow paths 771 to 773. The waste liquid on-off valves 781 to 783 are electromagnetic valves that are located in the waste liquid flow paths 771 to 773, respectively. The pump 905 is selectively connected to the waste liquid flow paths 771 to 773 in accordance with the opening and closing of the electromagnetic valves.

The cap 67 is able to cover the head 110 of the head unit 200. The waste liquid flow paths 775, 776 are respectively connected to the first area 661 and the second area 662 of the cap 67. At its upstream end, the waste liquid flow path 777 is provided with the connection portion 777A, which is able to connect to the drain outlets 765C to 768C. The waste liquid flow paths 775 to 777 converge at a convergence portion 792 and are connected to the waste liquid tank 706 through the pump 906. The waste liquid tank 706 stores the ink that has flowed out from the cap 67 and the drain outlets 765C to 768C. The pump 906 sucks up the color inks from the cap 67 and the drain outlets 765C to 768C through the waste liquid flow paths 775 to 777. The waste liquid on-off valves 784 to 786 are electromagnetic valves that are located in the waste liquid flow paths 775 to 777, respectively. The pump 906 is selectively connected to the waste liquid flow paths 775 to 777 in accordance with the opening and closing of the electromagnetic valves.

If the printer 1 performs the circulation operation when the cap 67 is in the covering position, the operation of the pumps 901, 902 causes the white ink in the interior of the first supply flow paths 711, 712 to flow into the circulation flow paths 731, 732, respectively, through the connection portions 756A, 757A. The white ink that has flowed into the circulation flow paths 731, 732 then once again flows into the first supply flow paths 711, 712 at the connection portions 754A, 755A. The white ink thus circulates through the first supply flow paths 711, 712 and the circulation flow paths 731, 732. The possibility that the white ink will settle out in the first supply flow paths 711, 712 and the circulation flow paths 731, 732 is thus diminished.

Opening and Closing Mechanism of the Drain Outlets 761C to 764C

Figure 13:
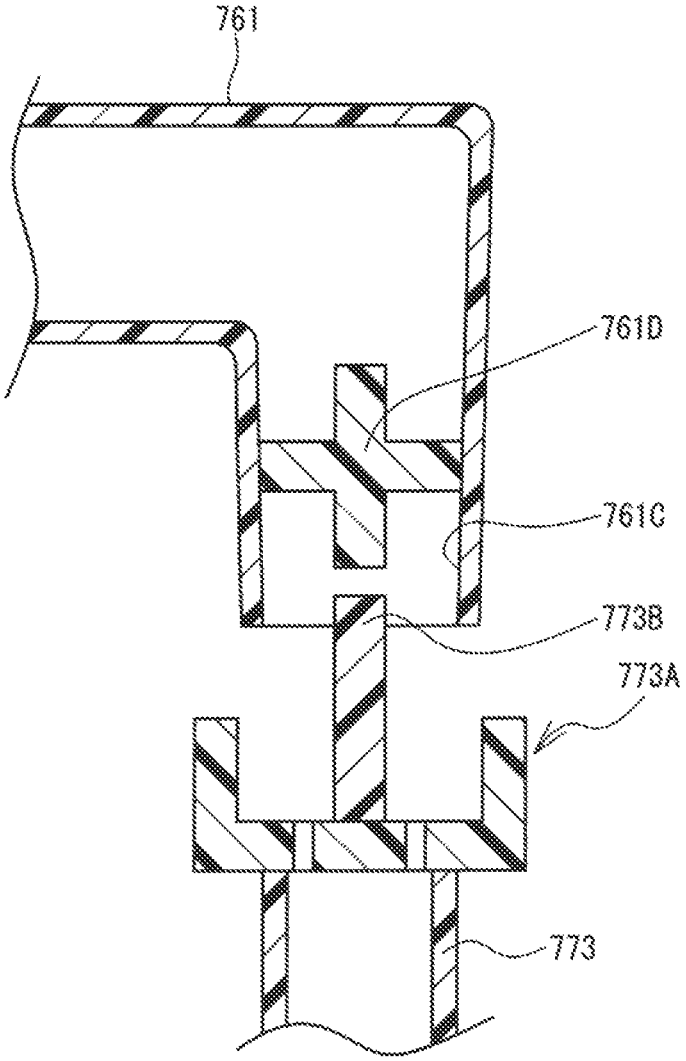
FIG. 13 is a schematic drawing that shows a structure that opens and closes a drain outlet.

The printer 1 performs the circulation operation in a state in which the first supply flow paths 711 to 714 and the circulation flow paths 731 to 734 are not open to the atmosphere. In a state in which the connection portion 773A of the waste liquid flow path 773 is not connected to the drain outlets 761C, 762C, 763C, 764C, as shown in FIGS. 4 and 5, the drain outlets 761C, 762C, 763C, 764C are closed, and the first supply flow paths 711 to 714 and the circulation flow paths 731 to 734 are in a state of not being open to the atmosphere. For example, as shown in FIG. 13, a valve 761D is located in the interior of the drain outlet 761C, and an energizing member that is not shown in the drawings causes the valve 761D to seal off the drain outlet 761C. The drain outlets 762C to 764C have the same sort of structure. In a state in which the connection portion 773A is connected to the drain outlet 761C, a shaft 773B of the connection portion 773A pushes the valve 761D upward, such that the drain outlet 761C opens. Therefore, the gas in the interior of the waste liquid flow path 773 and the flow path to the pump 905 enters the drain flow paths 761, 762. The first supply flow paths 711 to 714 and the circulation flow paths 731 to 734 are not provided with openings to the atmosphere, so the connection portion 773A is tightly sealed to the drain outlet 761C. Therefore, in the embodiment that is described above, the drain outlet 761C is not in a state of being open to the atmosphere. An actuator (not shown in the drawings) that operates in accordance with a command from a CPU 11 that will be described later moves the connection portion 773A up and down. The drain outlets 762C to 764C are configured in the same manner as the drain outlet 761C.

If the printer 1 performs purging when the cap 67 is in the covering position, the gas that has entered the interior of the ink flow path system 700 flows, along with the ink inside the ink flow path system 700, to the outside of the ink flow path system 700 from the drain outlets 761C, 762C, without passing through the heads 110. For example, in a state in which the connection portion 773A is connected to the drain outlets 761C, 762C, the waste liquid on-off valves 781, 782 close in conjunction with the opening of the waste liquid on-off valve 783. The printer 1 operates the pump 905 in this state in which the waste liquid on-off valves 781, 782 are closed. Therefore, negative pressure acts on the drain flow paths 761, 762 and the first supply flow paths 711, 712, such that the white ink inside the first flow path 71A flows to the waste liquid tank 706 through the waste liquid flow path 773. In the state in which the cap 67 is in the covering position, the waste liquid on-off valve 783 closes in conjunction with the opening of the waste liquid on-off valves 781, 782. The printer 1 performs purging by operating the pump 905 to generate negative pressure in the first area 661 and the second area 662 of the cap 67.

The printer 1 performs the printing operation when the head units 100, 200 are in the printing area 130 (refer to FIG. 2). The white ink contains pigment components that are more prone to sedimentation than are the pigment components of the color inks. The possibility therefore exists that the pigment of the white ink will settle out in the interior of the first flow paths 71A, 71B. The printer 1 provides the circulation flow paths 731 to 734 for the respective first supply flow paths 711 to 714 that are connected to the head unit 100. Therefore, the white ink is agitated by being circulated through the first flow paths 71A, 71B. The printer 1 is therefore able to prevent the white ink pigment from settling out in the first flow paths 71A, 71B and can prevent the white ink pigment from concentrating in the first supply flow paths 711 to 714. The printer 1 is therefore able to maintain the printing quality.

Electrical Configuration of the Printer 1

Figure 6:
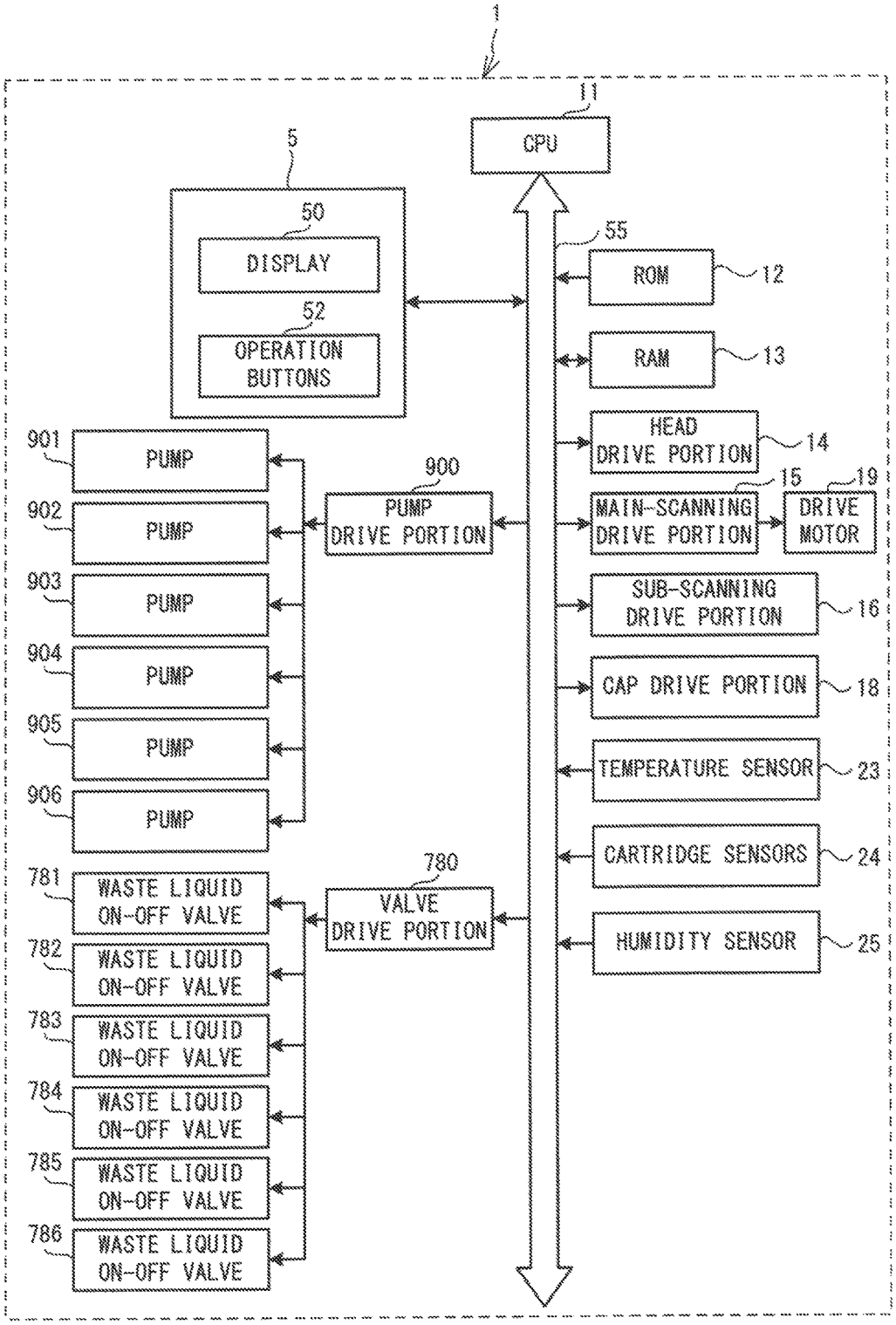
FIG. 6 is a block diagram that shows an electrical configuration of the printer.

As shown in FIG. 6, the printer 1 is provided with the CPU 11, which performs overall control of the printer 1. Through a bus 55, the CPU 11 is electrically connected to a ROM 12, a RAM 13, a head drive portion 14, a main-scanning drive portion 15, an sub-scanning drive portion 16, a cap drive portion 18, the operation portion 5, a pump drive portion 900, a valve drive portion 780, a temperature sensor 23, cartridge sensors 24, and a humidity sensor 25.

The ROM 12 stores a control program by which the CPU 11 controls the printer 1, as well as initial values and the like. The RAM 13 temporarily stores various types of data that are used by the control program. The head drive portion 14 is electrically connected to the heads 110, which discharge the inks, and causes the inks to be discharged from the nozzles 113 by operating piezoelectric elements that are located in individual discharge channels of the heads 110 (refer to FIG. 3).

The main-scanning drive portion 15 includes the drive motor 19 (refer to FIG. 1), and it moves the carriage 20 in the left-right direction (the main-scanning direction). The sub-scanning drive portion 16 includes a motor that is not shown in the drawings, as well as gears and the like, and by operating the platen drive mechanism 6 (refer to FIG. 1), it moves the platen, which is not shown in the drawings, in the front-rear direction (the sub-scanning direction).

The cap drive portion 18 includes a cap drive motor (not shown in the drawings), as well as gears and the like, and it moves the cap 67 up and down. The operation of the cap drive portion 18 moves the cap 67 of the maintenance portion 141 and the cap support portion 69 of the maintenance portion 142 up and down simultaneously. The operation portion 5 is provided with the display 50 and the operation buttons 52. The outputs from the operation buttons 52 are input to the CPU 11.

The temperature sensor 23 is located in the head 110, for example, and it detects the temperature of the head 110. The output from the temperature sensor 23 is input to the CPU 11, and the CPU 11 processes it as an input value. The CPU 11 derives the temperature in accordance with the input value. A thermistor is an example of the temperature sensor 23. The cartridge sensors 24 are located in the lower mounting portions 811, 812, and they detect that the mounting of the cartridges 311 to 324. An optical sensor is an example of the cartridge sensor 24. The cartridge sensors 24 output ON signals when the cartridges 311 to 324 are mounted in the corresponding lower mounting portions 811, 812, for example. The ON signals are not output when the cartridges 311 to 324 have not been mounted. The humidity sensor 25 is located inside the housing 2 and detects the humidity. The pump drive portion 900 controls the pumps 901 to 906. The valve drive portion 780 controls the waste liquid on-off valves 781 to 786, which are electromagnetic valves.

It is desirable for the printer 1 to perform the circulation operation if a fixed length of time, such as one hour or the like, has elapsed since the circulation operation was last performed. However, the circulation operation cannot be performed when the fixed length of time has elapsed in a state in which the power supply to the printer 1 or the pumps 901 to 904 has been turned off, or the cartridges 311, 312 have not been mounted. When a state in which the circulation operation can be performed has been restored, after a state in which the circulation operation could not be performed, it is conceivable that the state of settling out in the ink will have become worse. If the same circulation operation is performed in this worsened state as would be performed after the fixed length of time has elapsed, there is a possibility that ink will not recover adequately from its settled-out state. In the present embodiment, the length of the circulation operation can be modified in accordance with the length of time that has elapsed since the last circulation operation. Hereinafter, the circulation processing will be explained in detail. The present embodiment modifies the speeds of the pumps 901 to 904 in accordance with the temperature, based on the output value from the temperature sensor 23.

Details of Circulation Processing

Figure 7:
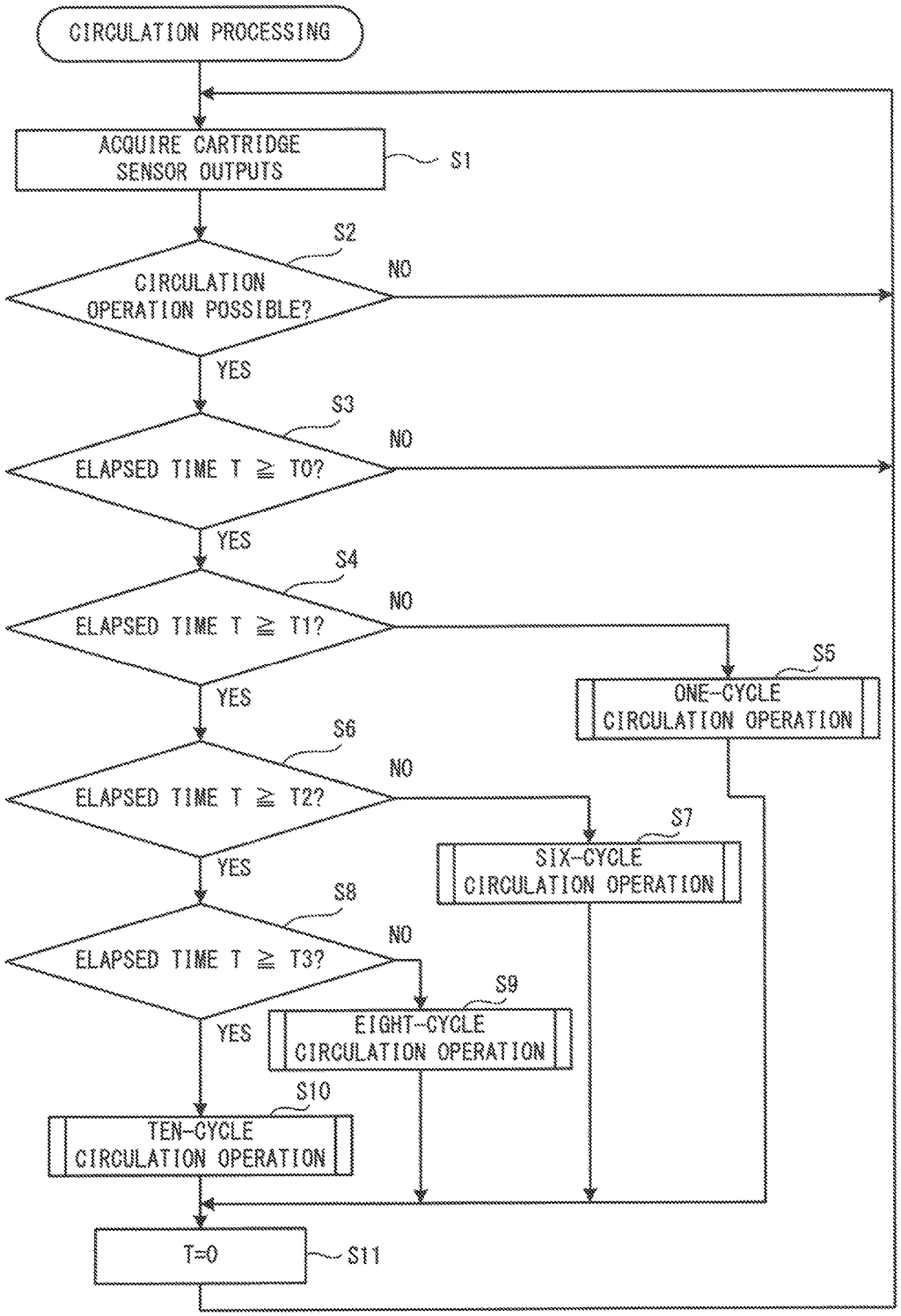
FIG. 7 is a flowchart of circulation processing.

The circulation processing by the CPU 11 of the printer 1 will be explained with reference to FIGS. 7 to 9. In the explanation that follows an elapsed time T is a counter that measures the time since the circulation operation was finished. The elapsed time T is stored in the RAM 13. In the processing at Step S11, which will be described later, the CPU 11 resets the elapsed time T to zero. A counter n that will be described later is a counter that counts the number of times the circulation operation has been performed. The counter n is also stored in the RAM 13. In the processing at one of Step S69 and Step S169, the CPU 11 resets the counter n to zero. A fixed time T0, a first time T1, a second time T2, a third time T3, a first temperature, and a second temperature, all of which will be described later, are stored in the ROM 12. The fixed time T0 is shorter than the first time T1. The first time T1 is shorter than the second time T2. The second time T2 is shorter than the third time T3. The first temperature is lower than the second temperature. In the circulation processing, the CPU 11 performs the circulation operation that is described above. By operating based on the control program that is stored in the ROM 12, the CPU 11 controls the printer 1 to perform the circulation processing that is shown in FIG. 7. First, the CPU 11 acquires the outputs from the cartridge sensors 24 (Step S1). Next, the CPU 11 determines whether the circulation operation can be performed (Step S2). The state in which the circulation operation can be performed is defined as a state in which a signal indicating that the power supply for all of the pumps 901 to 904 is in an ON state has been input, the outputs that were acquired at Step S1 show that the cartridge sensors 24 that are located in the lower mounting portions 811, 812 indicate that the cartridges 311 to 324 have been mounted, and processing for a maintenance operation such as purging or the like is not currently operating. When the CPU 11 does not determine that the circulation operation can be performed (NO at Step S2), it returns the processing to Step S1. When the CPU 11 does determine that the circulation operation can be performed (YES at Step S2), the CPU 11 determines whether the elapsed time T since the circulation operation was last performed is not less than the fixed time T0 (Step S3). The fixed time T0 may be one hour, for example. When the CPU 11 does not determine that the elapsed time T is not less than the fixed time T0 (NO at Step S3), it returns the processing to Step S1. Therefore, when the elapsed time T since the circulation operation was last performed is less than the fixed time T0, the CPU 11 does not perform the circulation operation.

When the CPU 11 does determine that the elapsed time T is not less than the fixed time T0 (YES at Step S3), the CPU 11 determines whether the elapsed time T since the circulation operation was last performed is not less than the first time T1 (Step S4). The first time T1 may be 1.5 hours, for example. When the CPU 11 does not determine that the elapsed time T is not less than the first time T1 (NO at Step S4), it performs a one-cycle circulation operation (Step S5).

One-Cycle Circulation Operation

The one-cycle circulation operation is a circulation operation whose time serves as the unit of the circulation operation. A circulation time, which is the time that the circulation operation will be performed in accordance with the temperature of the head 110 that was detected by the temperature sensor 23, is stored in the ROM 12. For example, when the temperature is not greater than 10° C., the circulation time is 120 seconds. When the temperature is greater than 10° C. and not greater than 18° C., the circulation time is 80 seconds. When the temperature is greater than 18° C., the circulation time is 60 seconds. The circulation time becomes longer when the temperature is lower and shorter when the temperature is higher. The circulation velocity of the ink is set such that it is slower when the temperature is lower. For example, when the temperature is not greater than 10° C., the circulation velocity of the ink is Vd. When the temperature is greater than 10° C. and not greater than 18° C., the circulation velocity is Vc. When the temperature is greater than 18° C., the circulation velocity is Vb. The magnitude relationship of the circulation velocities is Vd<Vc<Vb. The circulation velocity of the ink is related to the rotation speed of the pumps 901 to 904 that perform the circulation operation. As the rotation speed of the pumps 901 to 904 becomes greater, the circulation velocity of the ink becomes greater. For example, the rotation speed of the pumps 901 to 904 that generates the circulation velocity Vd is 179 rpm, the rotation speed of the pumps 901 to 904 that generates the circulation velocity Vc is 202 rpm, and the rotation speed of the pumps 901 to 904 that generates the circulation velocity Vb is 225 rpm. The rotation speed for the pumps 901 to 904 is also stored in the ROM 12.

Figure 8:
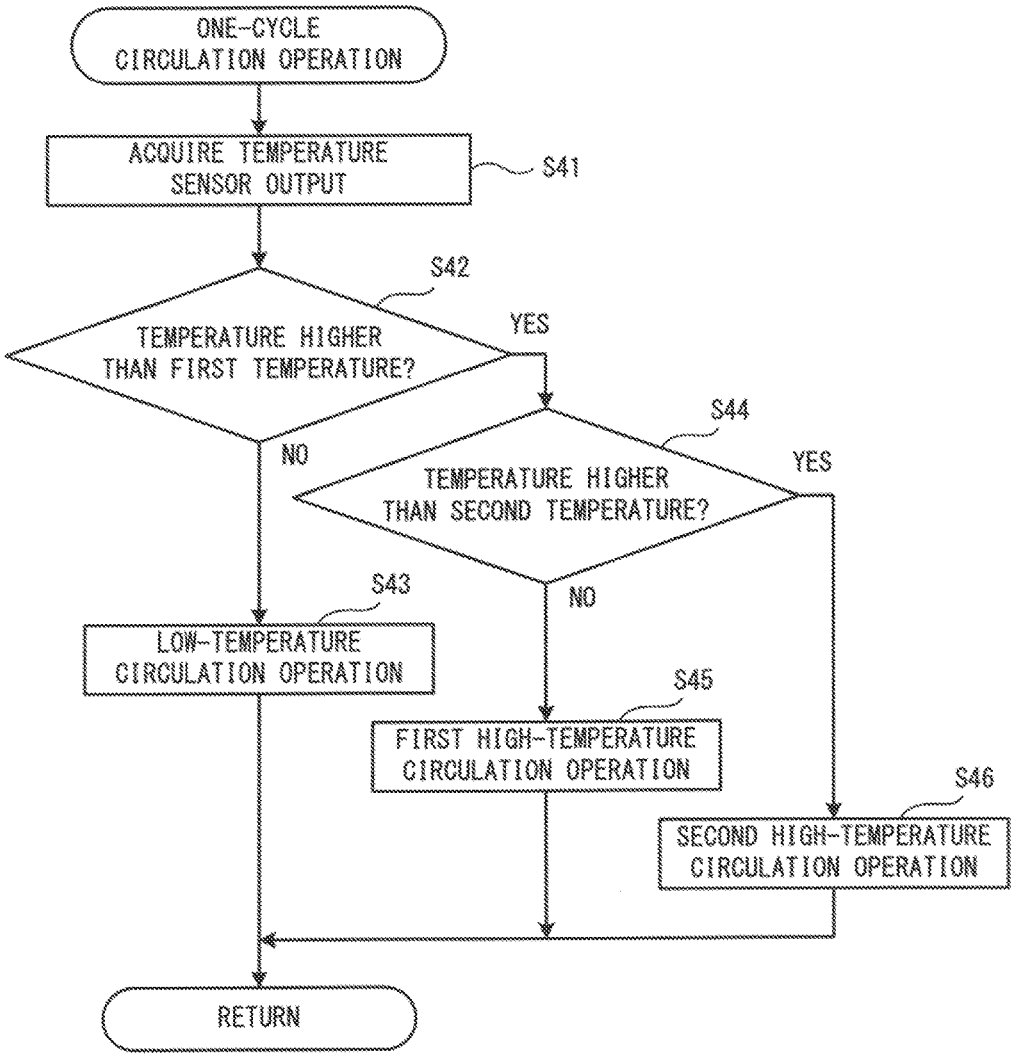
FIG. 8 is a flowchart of a one-cycle circulation operation.

The CPU 11 performs the one-cycle circulation operation (Step S5) according to the one-cycle circulation operation flowchart that is shown in FIG. 8. The CPU 11 acquires the output from the temperature sensor 23 (Step S41). The CPU 11 derives the temperature by using the output from the temperature sensor 23 as an input value. The CPU 11 determines whether the temperature that it has derived based on the input value from the temperature sensor 23 is higher than the first temperature (Step S42).

When the CPU 11 determines that the temperature that was derived based on the input value from the temperature sensor 23 is not higher than the first temperature (NO at Step S42), it performs a low-temperature circulation operation (Step S43). For example, when the first temperature is 10° C., the CPU 11 performs the low-temperature circulation operation by controlling the pump drive portion 900 to operate the pumps 901 to 904 (Step S43) such that the circulation time is 120 seconds and the maximum rotation speed of the pumps 901 to 904 is not greater than 179 rpm. When the CPU 11 determines that the temperature that was derived based on the input value from the temperature sensor 23 is higher than the first temperature (YES at Step S42), the CPU 11 determines whether the temperature that it has derived based on the input value from the temperature sensor 23 is higher than the second temperature (Step S44). When the CPU 11 determines that the temperature that was derived based on the input value from the temperature sensor 23 is not higher than the second temperature (NO at Step S44), it performs a first high-temperature circulation operation (Step S45). For example, when the second temperature is 18° C., the CPU 11 performs the first high-temperature circulation operation by controlling the pump drive portion 900 to operate the pumps 901 to 904 (Step S45) such that the circulation time is 80 seconds and the maximum rotation speed of the pumps 901 to 904 is greater than it was during the low-temperature circulation operation, but is less than 225 rpm.

When the CPU 11 determines that the temperature that was derived based on the input value from the temperature sensor 23 is higher than the second temperature (YES at Step S44), it performs a second high-temperature circulation operation (Step S46). For example, when the second temperature is 18° C., the CPU 11 performs the second high-temperature circulation operation by controlling the pump drive portion 900 to operate the pumps 901 to 904 (Step S46) such that the circulation time is 60 seconds and the maximum rotation speed of the pumps 901 to 904 is greater than it was during the first high-temperature circulation operation and is not greater than 225 rpm. Thereafter, the CPU 11 returns the processing to Step S5 and terminates the one-cycle circulation operation (Step S5). The CPU 11 resets the elapsed time T to zero (Step S11) and returns the processing to Step S1.

Six-Cycle Circulation Operation

As shown in FIG. 7, when the CPU 11 determines that the elapsed time T is not less than the first time T1 (YES at Step S4), it determines whether the elapsed time T is not less than the second time T2 (Step S6). When the CPU 11 does not determine that the elapsed time T is not less than the second time T2 (NO at Step S6), it performs a six-cycle circulation operation (Step S7) according to the six-cycle circulation operation flowchart that is shown in FIG. 9. Assume that the second time T2 is 18 hours, for example. The six-cycle circulation operation is an operation in which the one-cycle circulation operation is performed six times in succession.

Figure 9:
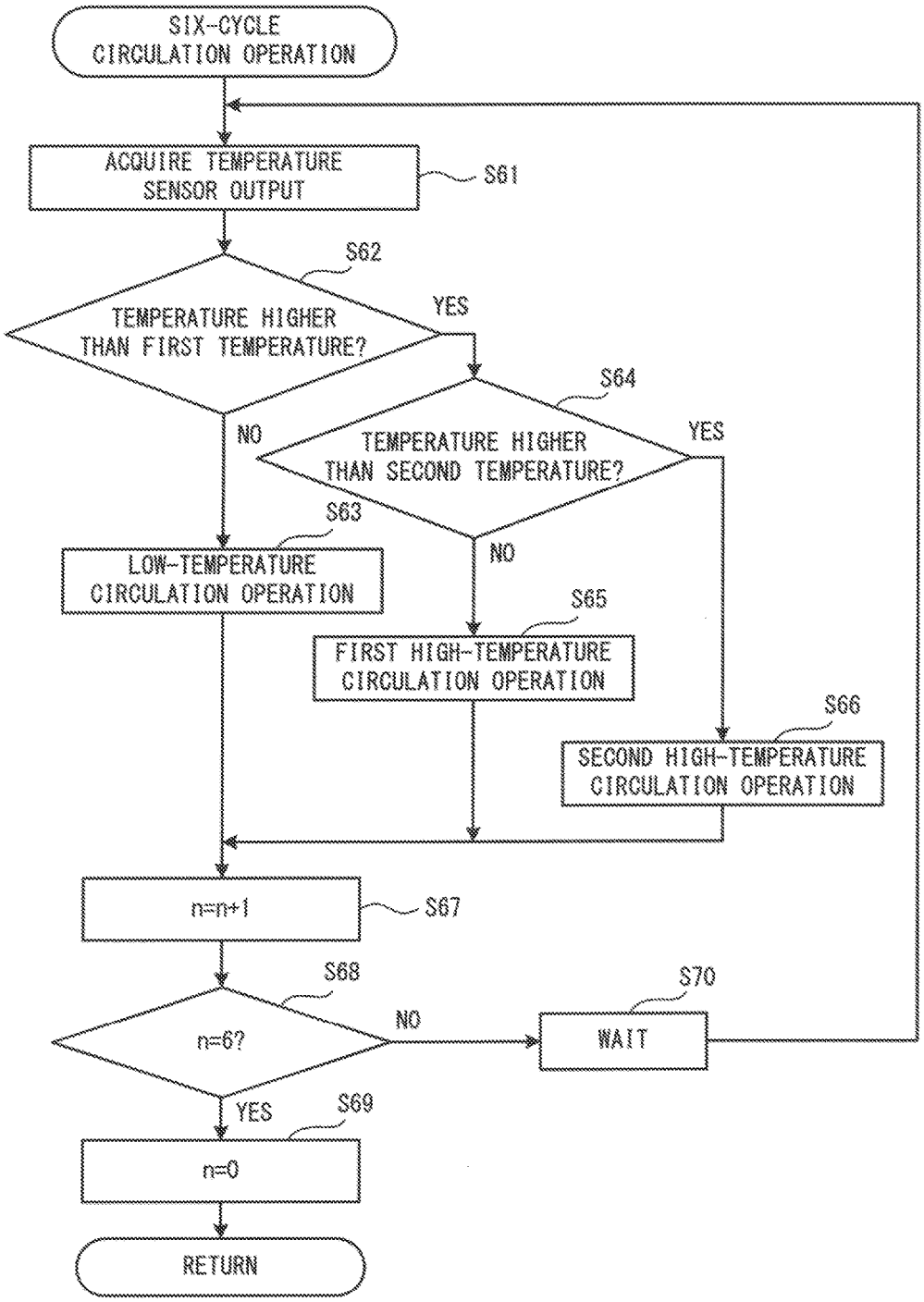
FIG. 9 is a flowchart of a six-cycle circulation operation.

The processing at Steps S61 to S66 in the six-cycle circulation operation flowchart that is shown in FIG. 9 is the same as the processing at Steps S41 to S46 in the one-cycle circulation operation flowchart that is shown in FIG. 8, so an explanation of that processing will be omitted. In the six-cycle circulation operation flowchart, each time the CPU 11 performs one of the low-temperature circulation operation (Step S63), the first high-temperature circulation operation (Step S65), and the second high-temperature circulation operation (Step S66), the CPU 11 increments by 1 the value of the counter n, which counts the number of times the circulation operation has been performed (Step S67). Next, the CPU 11 determines whether the counter n is equal to 6 (Step S68). When the CPU 11 determines that the counter n is not equal to 6 (NO at Step S68), it waits (Step S70) for five seconds, for example, then returns the processing to Step S61. When the CPU 11 determines that the counter n is equal to 6 (YES at Step S68), it resets the counter n to zero (Step S69), then terminates the six-cycle circulation operation (Step S7). The CPU 11 resets the elapsed time T to zero (Step S11), then returns the processing to Step S1.

Eight-Cycle Circulation Operation

As shown in FIG. 7, when the CPU 11 determines that the elapsed time T is not less than the second time T2 (YES at Step S6), it determines whether the elapsed time T is not less than the third time T3 (Step S8). When the CPU 11 does not determine that the elapsed time T is not less than the third time T3 (NO at Step S8), it performs an eight-cycle circulation operation (Step S9). Assume that the third time T3 is 66 hours, for example. The eight-cycle circulation operation is an operation in which the one-cycle circulation operation is performed eight times in succession. The eight-cycle circulation operation differs from the six-cycle circulation operation flowchart that is shown in FIG. 9 only in that, in the determination processing at Step S68, the CPU 11 determines whether the counter n is equal to 8, instead of to 6. The rest of the processing is the same, so a detailed explanation will be omitted. After terminating the eight-cycle circulation operation (Step S9), the CPU 11 resets the elapsed time T to zero (Step S11), then returns the processing to Step S1.

Ten-Cycle Circulation Operation

When the CPU 11 determines that the elapsed time T is not less than the third time T3 (YES at Step S8), it performs a ten-cycle circulation operation (Step S10). The ten-cycle circulation operation is an operation in which the one-cycle circulation operation is performed ten times in succession. The ten-cycle circulation operation differs from the six-cycle circulation operation flowchart that is shown in FIG. 9 only in that, in the determination processing at Step S68, the CPU 11 determines whether the counter n is equal to 10, instead of to 6. The rest of the processing is the same, so a detailed explanation will be omitted. After terminating the ten-cycle circulation operation (Step S10), the CPU 11 resets the elapsed time T to zero (Step S11), then returns the processing to Step S1.

Remaining Time Display

Figure 12A:
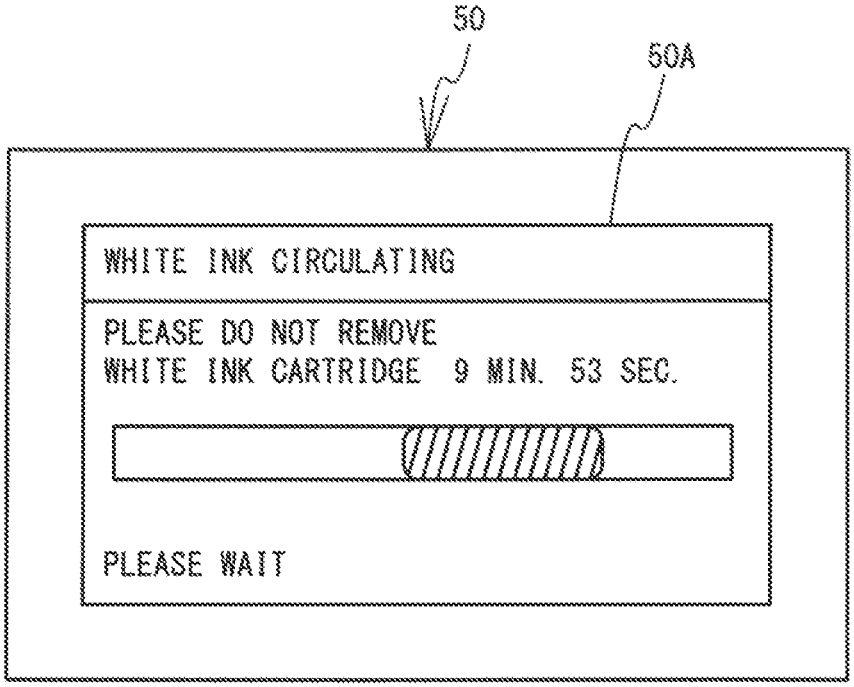
FIGS. 12A and 12B are figures that show a screen that is displayed on a display.
Figure 12B:
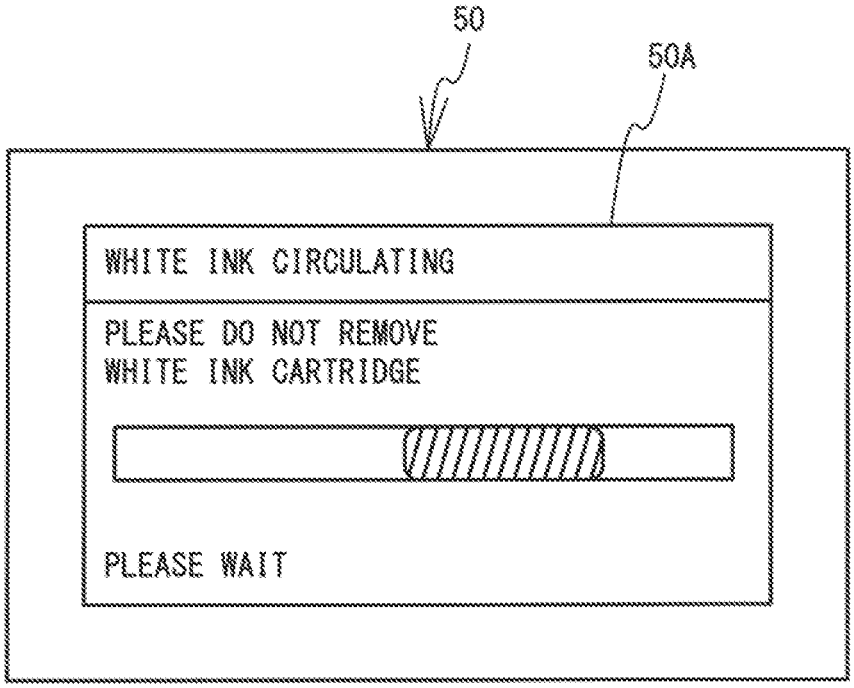

The operation time for the one-cycle circulation operation that is described above is from 60 to 120 seconds, depending on the temperature that is indicated by the information from the temperature sensor 23. The six-cycle circulation operation takes at least six times as long as the one-cycle circulation operation, the eight-cycle circulation operation takes at least eight times as long as the one-cycle circulation operation, and the ten-cycle circulation operation takes at least ten times as long as the one-cycle circulation operation. Accordingly, the operation times for the six-cycle to the ten-cycle circulation operations are long, so while any one of the six-cycle circulation operation (Step S7), the eight-cycle circulation operation (Step S9), and the ten-cycle circulation operation (Step S10) is in progress, the CPU 11 displays on the display 50 a screen 50A that shows the time remaining until the operation is finished, as shown in FIG. 12A. The user can therefore easily know that the circulation operation is in progress. It is therefore possible to prevent the user from removing the cartridges 311, 312 while the circulation operation is in progress. The circulation time for the one-cycle circulation operation is short. Therefore, while the one-cycle circulation operation (Step S5) is in progress, the CPU 11 does not display the time remaining on the screen 50A of the display 50, as shown in FIG. 12B.

Test Results for Nozzle 113 Discharge Problems after Circulation Operation

If a problem occurs in the discharge of the ink from one of the nozzles 113, a line is formed on the printed surface where image elements are missing because the ink was not discharged. A discharge problem in the nozzles 113 affects the printing quality. When the circulation flow paths are not open to the atmosphere, the pressure within the circulation flow paths tends to become lower than the atmospheric pressure, and that lower pressure makes it difficult to maintain a meniscus that is formed in the nozzle 113. The pressure within the circulation flow paths is proportional to the viscosity of the ink, and the viscosity is inversely proportional to the temperature and the humidity. Therefore, if a low temperature or a low humidity is set, the pressure becomes greater, and the difference between the pressure within the circulation flow paths and the atmospheric pressure becomes greater. It therefore becomes more difficult to maintain the meniscus. The circulation flow path pressure becomes greater if the rotation speed of the pumps 901 to 904 increases. The difference between the circulation flow path pressure and the atmospheric pressure therefore becomes greater, and it becomes more difficult to maintain the meniscus. If the meniscus cannot be maintained, problems occur in the discharge of the ink from the nozzle 113. When the circulation flow paths are not open to the atmosphere, the printing quality tends to be affected by temperature changes, humidity changes, and the pump rotation speed. The inventor performed tests of problems in the discharge of the ink from the nozzle 113 by performing the circulation operation using the temperature, the humidity, and the pump rotation speed as parameters.

The inventor performed the circulation operation while varying the rotation speed of the pumps 901 to 904 at various temperatures (10° C., 18° C., 24° C., 30° C., 35° C.). After the circulation operation, the inventor checked for the presence of missing image elements by performing printing by causing the nozzles 113 of the head 110 to discharge the white ink. The standard for acceptable results was the complete absence of missing image elements. The results are shown in Table 1 below.

TABLE 1

| Pump | | Temperature (° C.) 10 | 18 | 24 | 30 | 35 |
|---|---|---|---|---|---|---|
| Rotation | 155 | ○ | ○ | ○ | ○ | ○ |
| Speed | 179 | ○ | ○ | ○ | ○ | ○ |
| (rpm) | 202 | x | ○ | ○ | ○ | ○ |
| | 225 | x | ○ | ○ | ○ | ○ |

TABLE 1-continued

| Pump | Temperature (° C.) | | | | |
|---|---|---|---|---|---|
| | 10 | 18 | 24 | 30 | 35 |
| 257 | x | x | ○ | ○ | ○ |
| 302 | x | x | x | ○ | ○ |

The speed range within which the pumps 901 to 904 can operate mechanically is 80 rpm to 600 rpm, for example. In contrast, based on the test results above, the maximum rotation speeds of the pumps 901 to 904 at which missing image elements do not occur after the circulation operation are as described below. When the temperature of the head 110 is 10° C., the maximum rotation speed is 179 rpm. When the temperature of the head 110 is 18° C., the maximum rotation speed is 225 rpm. When the temperature of the head 110 is 24° C., the maximum rotation speed is 257 rpm. When the temperature of the head 110 is 30° C. or 35° C., the maximum rotation speed is 302 rpm. In order for the circulation operation to agitate the ink, it is necessary to impart a fixed flow velocity to the ink, so it is necessary for the rotation speed of the pumps 901 to 904 to be set to at least 100 rpm.

The inventor performed the circulation operation while varying the rotation speeds of the pumps 901 to 904 at various humidities (20%, 35%, 50%, 80%). After the circulation operation, the inventor checked for the presence of missing image elements. The results are shown in Table 2 below.

TABLE 2

| Pump | | Humidity (%) | | | |
|---|---|---|---|---|---|
| | | 20 | 35 | 50 | 80 |
| Rotation Speed (rpm) | 155 | ○ | ○ | ○ | ○ |
| | 179 | ○ | ○ | ○ | ○ |
| | 202 | X | ○ | ○ | ○ |
| | 225 | X | ○ | ○ | ○ |
| | 257 | X | X | ○ | ○ |
| | 302 | X | X | X | ○ |

Based on the test results above, the maximum rotation speeds of the pumps 901 to 904 at which missing image elements do not occur after the circulation operation are as described below. When the humidity is 20%, the maximum rotation speed is 179 rpm. When the humidity is 35%, the maximum rotation speed is 225 rpm. When the humidity is 50%, the maximum rotation speed is 257 rpm. When the humidity is 80%, the maximum rotation speed is 302 rpm.

Modified Example of the Circulation Processing

Figure 14:
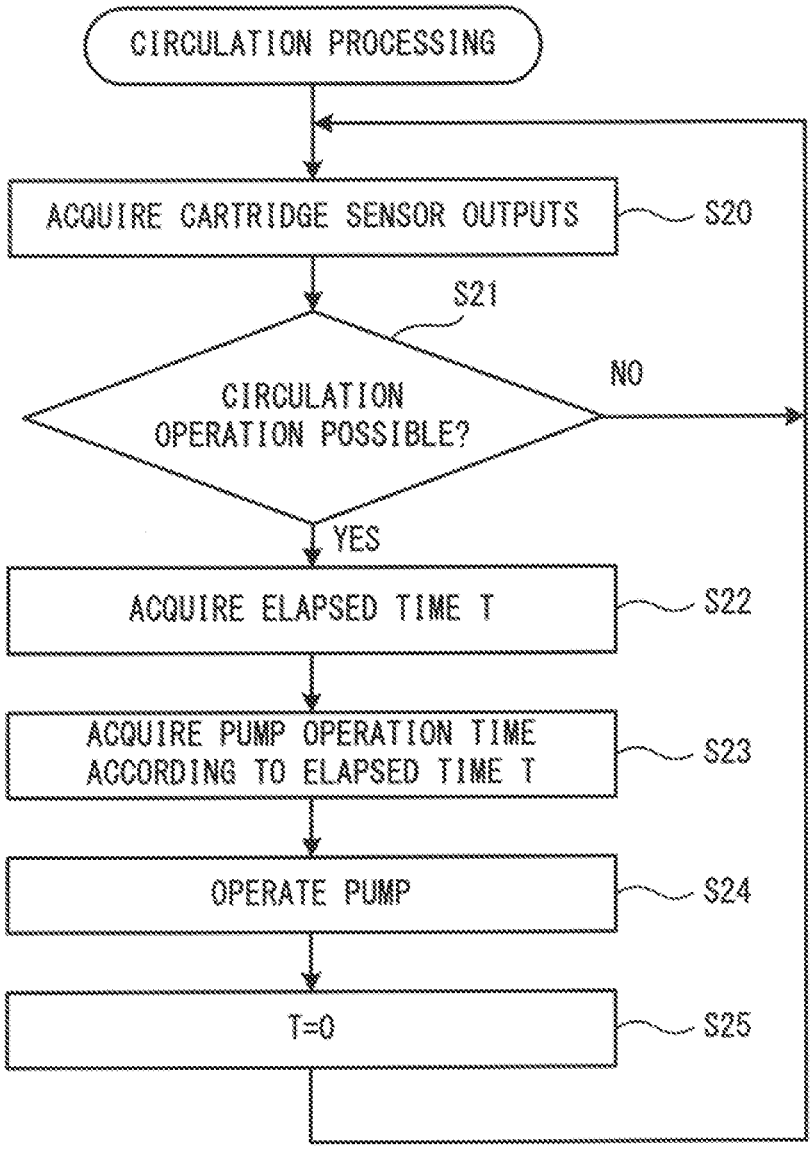
FIG. 14 is a flowchart that shows a modified example of the circulation processing.

A modified example of the circulation processing will be explained with reference to the flowchart in FIG. 14. In the circulation processing that is shown in FIG. 7, the CPU 11 makes determinations about the elapsed time T in the four Steps S3, S4, S6, and S8, in accordance with the elapsed time. In contrast, in the modified example of the circulation processing in the flowchart in FIG. 14, the CPU 11 acquires the outputs of the cartridge sensors 24 (Step S20). Next, the CPU 11 determines whether the circulation operation can be performed (Step S21). When the CPU 11 determines that the circulation operation can be performed (YES at Step S21), it acquires the elapsed time T since the last time the circulation operation was performed (Step S22). From a data table that is stored in the ROM 12, the CPU 11 acquires operation time for the pumps 901 to 904 that are in accordance with the elapsed time T that was acquired in the processing at Step S22 (Step S23).

For example, when the elapsed time T is not less than one hour and less than 1.5 hours, and the temperature is not greater than 10° C., the CPU 11 acquires a circulation time of 120 seconds. When the elapsed time T is not less than one hour and less than 1.5 hours, and the temperature is greater than 10° C. and not greater than 18° C., the CPU 11 acquires a circulation time of 80 seconds. When the elapsed time T is not less than one hour and less than 1.5 hours, and the temperature is greater than 18° C., the CPU 11 acquires a circulation time of 60 seconds (Step S23). When the elapsed time T is not less than 1.5 hours and less than 18 hours, and the temperature is not greater than 10° C., the CPU 11 acquires a circulation time of six times 120 seconds, or 720 seconds. When the elapsed time T is not less than 1.5 hours and less than 18 hours, and the temperature is greater than 10° C. and not greater than 18° C., the CPU 11 acquires a circulation time of six times 80 seconds, or 480 seconds. When the elapsed time T is not less than 1.5 hours and less than 18 hours, and the temperature is greater than 18° C., the CPU 11 acquires a circulation time of six times 60 seconds, or 360 seconds (Step S23). When the elapsed time T is not less than 18 hours and less than 66 hours, and the temperature is not greater than 10° C., the CPU 11 acquires a circulation time of eight times 120 seconds, or 960 seconds. When the elapsed time T is not less than 18 hours and less than 66 hours, and the temperature is greater than 10° C. and not greater than 18° C., the CPU 11 acquires a circulation time of eight times 80 seconds, or 640 seconds. When the elapsed time T is not less than 18 hours and less than 66 hours, and the temperature is greater than 18° C., the CPU 11 acquires a circulation time of eight times 60 seconds, or 480 seconds (Step S23). When the elapsed time T is not less than 66 hours, and the temperature is not greater than 10° C., the CPU 11 acquires a circulation time of ten times 120 seconds, or 1200 seconds. When the elapsed time T is not less than 66 hours, and the temperature is greater than 10° C. and not greater than 18° C., the CPU 11 acquires a circulation time of ten times 80 seconds, or 800 seconds. When the elapsed time T is not less than 66 hours, and the temperature is greater than 18° C., the CPU 11 acquires a circulation time of ten times 60 seconds, or 600 seconds (Step S23).

The CPU 11 operates the pumps 901 to 904 for the operation time that was acquired by the processing at Step S23 (Step S24). Then the CPU 11 resets the elapsed time T to zero (Step S25) and returns the processing to Step S20. The CPU 11 also returns the processing to Step S20 when it does not determine that the circulation operation can be performed (NO at Step S21). In the modified example of the circulation processing, the processing in which the CPU 11 determines the length of the elapsed time T does not need to be performed four times and is thus simpler.

In the printer 1 of the embodiment that is described above, the CPU 11 performs first circulation processing when it determines that the elapsed time T since the circulation operation was last performed is not less than the fixed time T0 (YES at Step S3), but is less than the first time T1 (NO at Step S4). The first circulation processing is processing that uses the one-cycle circulation operation (Step S5) to circulate the ink in a state in which the first supply flow paths 711 to 714 and the circulation flow paths 731 to 734 are not open to the atmosphere. When the CPU 11 determines that the elapsed time T is not less than the first time T1 (YES at Step S4), but is less than the second time T2 (NO at Step S6), it performs second circulation processing. The second circulation processing is processing that uses the six-cycle circulation operation (Step S7) to circulate the ink in a state in which the first supply flow paths 711 to 714 and the circulation flow paths 731 to 734 are not open to the atmosphere. In order to agitate the ink more, either the circulation velocity of the ink must be increased or the ink must be circulated for a longer time. In a state in which the circulation flow paths are not open to the atmosphere, if the circulation velocity of the ink is made faster than it is in the one-cycle circulation operation (Step S5), there is a possibility that the meniscus that forms in the nozzle 113 will become difficult to maintain. In contrast, in the six-cycle circulation operation (Step S7), the one-cycle circulation operation is repeated six times, for example. Therefore, the six-cycle circulation operation is able to perform the circulation operation for a longer time than the one-cycle circulation operation can, but without increasing the circulation velocity of the ink. The ink can therefore be agitated more than in the one-cycle circulation operation. The meniscus that forms in the nozzle 113 can therefore be maintained, and the possibility that the agitating of the ink will cause a drop in the printing quality can be reduced.

When the time since the last time the circulation operation was performed becomes not less than the first time T1, the components of the ink settle out more. However, the CPU 11 performs the six-cycle circulation operation (Step S7), which agitates the liquid more than the one-cycle circulation operation (Step S5) does, in a state in which the first supply flow paths 711 to 714 and the circulation flow paths 731 to 734 are not open to the atmosphere. Therefore, the settling out of the ink components can be reduced by the six-cycle circulation operation (Step S7). The first supply flow paths 711 to 714 and the circulation flow paths 731 to 734 are not open to the atmosphere, so the ink in the supply flow paths and the circulation flow paths can be prevented from drying out, and dust and the like can be prevented from entering the supply flow paths and the circulation flow paths. The possibility that a drop in the printing quality will occur can therefore be reduced.

When the circulation flow paths are not open to the atmosphere, the pressure within the circulation flow paths tends to become less than the atmospheric pressure, which makes it more difficult to maintain the meniscus that forms in the nozzle 113. The pressure within the circulation flow paths is proportional to the viscosity of the ink, and the viscosity is inversely proportional to the temperature and the humidity. Therefore, if either the temperature or the humidity decreases, the circulation flow path pressure becomes greater, and the difference between the circulation flow path pressure and the atmospheric pressure becomes greater, making it more difficult to maintain the meniscus. The circulation flow path pressure becomes greater if the rotation speed of the pumps 901 to 904 increases. The difference between the circulation flow path pressure and the atmospheric pressure therefore becomes greater, and it becomes more difficult to maintain the meniscus. If the meniscus cannot be maintained, problems occur in the discharge of the ink from the nozzle 113. Therefore, the circulation velocity of the ink cannot be increased. If the circulation flow paths were open to the atmosphere, the rotation speed of the pumps 901 to 904 could be increased. However, in the present embodiment, the circulation flow paths are not open to the atmosphere. Therefore, the CPU 11 operates the pumps 901 to 904 in the range from 155 rpm to 302 rpm as the low rotation speed. Therefore, the concern that fluctuations in the pressure of the ink will destroy the meniscuses in the nozzles 113 of the head 110 can be reduced, even if the first supply flow paths 711 to 714 and the circulation flow paths 731 to 734 are not open to the atmosphere. In the embodiment that is described above, the ink is circulated within the first flow paths 71A, 71B, and the ink is not circulated within the heads 110. Therefore, the possibility does not arise that the meniscus that forms in the nozzle 113 will become difficult to maintain due to the circulating of the ink within the heads 110.

The printer 1 is provided with the temperature sensor 23 in the head 110. In at least one of the one-cycle circulation operation (Step S5) and the six-cycle circulation operation (Step S7), when the temperature that is based on the input value from the temperature sensor 23 is higher than the first temperature (YES at Step S42; YES at Step S62), the CPU 11 performs one of the first high-temperature circulation operation (Steps S45, S65) and the second high-temperature circulation operation (Steps S46, S66). When the temperature that is based on the input value from the temperature sensor 23 is not higher than the first temperature (NO at Step S42; NO at Step S62), the CPU 11 performs the low-temperature circulation operation (Steps S43, S63). The pumps 901 to 904 are able to revolve at 80 rpm to 600 rpm, for example. In the low-temperature circulation operation, the CPU 11 operates the pumps 901 to 904 at a low rotation speed, in accordance with the temperature. The low rotation speed is 179 rpm, for example. In the first high-temperature circulation operation and the second high-temperature circulation operation, the CPU 11 operates the pumps 901 to 904 at a low rotation speed, in accordance with the temperature. The low rotation speed is 302 rpm, for example. The CPU 11 performs the low-temperature circulation operation (Steps S43, S63) using at least one of a longer circulation time and a slower rotation speed for the pumps 901 to 904 than it uses in the first high-temperature circulation operation (Steps S45, S65) and the second high-temperature circulation operation (Steps S46, S66). When the circulation flow paths are not open to the atmosphere, the pressure within the circulation flow paths tends to become less than the atmospheric pressure, which makes it more difficult to maintain the meniscus that forms in the nozzle 113. The pressure within the circulation flow paths is proportional to the viscosity of the ink, and the viscosity is inversely proportional to the temperature. Therefore, if the temperature decreases, the circulation flow path pressure becomes greater, and the difference between the circulation flow path pressure and the atmospheric pressure becomes greater, making it more difficult to maintain the meniscus. The circulation velocity of the ink during the circulation operation is proportional to the rotation speed of the pumps 901 to 904. Therefore, if the rotation speed of the pumps 901 to 904 becomes slower, the circulation operation also becomes slower, and the circulation time becomes longer. However, the pressure of the ink that bears on the head 110 decreases, so the possibility that the meniscuses in the nozzles 113 will be destroyed can be reduced. In the embodiment that is described above, in accordance with the input value from the temperature sensor 23, the CPU 11 performs at least one of the one-cycle circulation operation (Step S5) (the first circulation operation) and the six-cycle circulation operation (Step S7) (the second circulation operation) by operating the pumps 901 to 904 at a low rotation speed in the range from 155 rpm to 302 rpm. The possibility that the meniscuses in the nozzles 113 will be destroyed can therefore be reduced.

In the at least one of the one-cycle circulation operation (Step S5) and the six-cycle circulation operation (Step S7), when the temperature that is based on the input value from the temperature sensor 23 is not higher than 10° C., the CPU 11 performs the low-temperature circulation operation by operating the pumps 901 to 904 at a rotation speed not greater than 179 rpm. Based on the test results that are shown in Table 1, 179 rpm is the maximum rotation speed of the pumps 901 to 904 when the temperature is not higher than 10° C. By performing the circulation operation at 179 rpm, the CPU 11 is able to shorten the operation time while also preventing any missing image elements from occurring in the printing.

When the CPU 11 determines that the elapsed time T since the last time the circulation operation was performed is not less than the first time T1 (YES at Step S4), but is less than the second time T2 (NO at Step S6), it performs the six-cycle circulation operation (Step S7). When the CPU 11 determines that the elapsed time T since the last time the circulation operation was performed is not less than the second time T2 (YES at Step S6), but is less than the third time T3 (NO at Step S8), it performs the eight-cycle circulation operation (Step S9). When the CPU 11 determines that the elapsed time T since the last time the circulation operation was performed is not less than the third time T3 (YES at Step S8), it performs the ten-cycle circulation operation (Step S10). Therefore, as the elapsed time T since the last time the circulation operation was performed becomes longer, the CPU 11 performs the circulation operation for a longer time. As the time since the last time the circulation operation was performed becomes longer, the components of the ink settle out more. However, because the circulation operation is performed for a longer time, the ink is agitated for a longer time. It is therefore possible to reduce the extent to which the components of the ink settle out.

When the CPU 11 determines that the elapsed time T since the last time the circulation operation was performed is not greater than the fixed time T0 (NO at Step S3), the CPU 11 does not perform the circulation operation. When the elapsed time T is not greater than the fixed time T0, the components of the ink do not settle out very much, so it is possible to prevent the circulation operation from being performed needlessly.

If the inputs from the cartridge sensors 24 are in a state in which no signals are detected that indicate that the cartridges 311, 312 have been mounted (NO at Step S2), the CPU 11 does not perform any one of the one-cycle circulation operation (Step S5), the six-cycle circulation operation (Step S7), the eight-cycle circulation operation (Step S9), and the ten-cycle circulation operation (Step S10). The reason for not performing the circulation operation is that no valves are provided in the ink supply outlets 611, 612, so if the circulation operation is performed in a state in which the cartridges 311, 312 are not mounted, there is a possibility that the ink will leak out of the ink supply outlets 611, 612. It is therefore possible to prevent the circulation operation from being performed when the cartridges 311, 312 have not been mounted.

One-Cycle Circulation Operation According to Humidity

Figure 10:
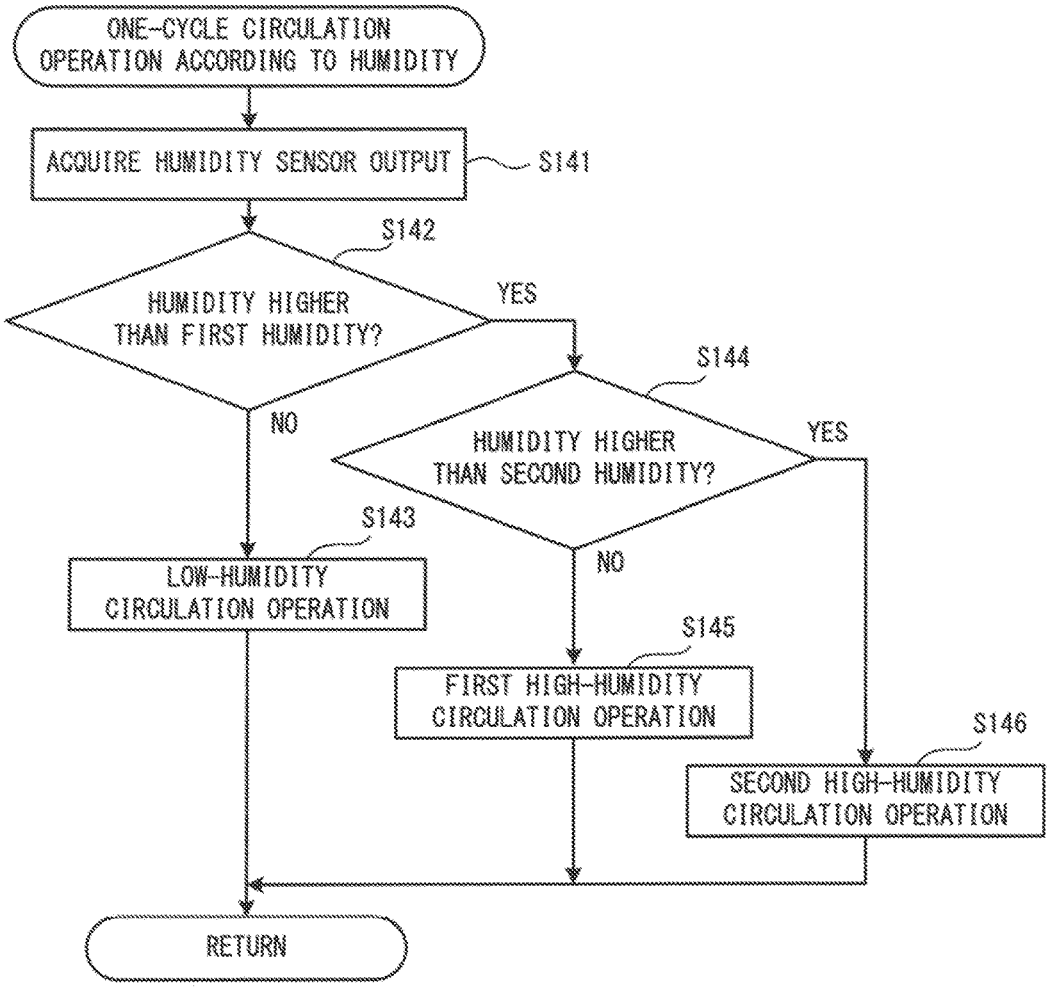
FIG. 10 is a flowchart of a one-cycle circulation operation according to humidity.

The printer 1 is provided with the humidity sensor 25. Hereinafter, the versions of the one-cycle circulation operation and the six-cycle circulation operation will be explained that operate according to the humidity that is derived based on the input value from the humidity sensor 25. In the explanation that follows, a first humidity and a second humidity are stored in the ROM 12. The first humidity is lower than the second humidity. The rotation speed for the pumps 901 to 904 is also stored in the ROM 12. In the flowchart for the one-cycle circulation operation that is shown in FIG. 8, the CPU 11 uses the temperature as the standard for choosing from among the low-temperature circulation operation, the first high-temperature circulation operation, and the second high-temperature circulation operation. The CPU 11 may also perform the one-cycle circulation operation (Step S5) in accordance with the flowchart that is shown in FIG. 10 for the one-cycle circulation operation according to the humidity. First, the CPU 11 acquires the output from the humidity sensor 25 (Step S141). The CPU 11 derives the humidity by using the output from the humidity sensor 25 as an input value. The CPU 11 determines whether the derived humidity is higher than the first humidity (Step S142).

When the CPU 11 determines that the humidity it derived based on the input value from the humidity sensor 25 is not higher than the first humidity (NO at Step S142), the CPU 11 performs a low-humidity circulation operation (Step S143). When the first humidity is 20%, for example, the CPU 11 controls the pump drive portion 900 to operate the pumps 901 to 904 such that the circulation time of the low-humidity circulation operation is 120 seconds, for example, and the maximum rotation speed of the pumps 901 to 904 is not greater than 179 rpm. When the CPU 11 determines that the humidity it derived based on the input value from the humidity sensor 25 is higher than the first humidity (YES at Step S142), the CPU 11 determines whether the humidity it derived based on the input value from the humidity sensor 25 is higher than the second humidity (Step S144). When the CPU 11 determines that the humidity it derived based on the input value from the humidity sensor 25 is not higher than the second humidity (NO at Step S144), the CPU 11 performs a first high-humidity circulation operation (Step S145). When the second humidity is 35%, for example, the CPU 11 controls the pump drive portion 900 to operate the pumps 901 to 904 such that the circulation time of the first high-humidity circulation operation is 80 seconds, for example, and the maximum rotation speed of the pumps 901 to 904 is greater than the rotation speed that is used in the low-humidity circulation operation, but less than 225 rpm.

When the CPU 11 determines that the humidity it derived based on the input value from the humidity sensor 25 is higher than the second humidity (YES at Step S144), the CPU 11 performs a second high-humidity circulation operation (Step S146). When the second humidity is 35%, for example, the CPU 11 controls the pump drive portion 900 to operate the pumps 901 to 904 such that the circulation time of the first high-humidity circulation operation is 60 seconds, for example, and the maximum rotation speed of the pumps 901 to 904 is greater than the rotation speed that is used in the first high-humidity circulation operation and not greater than 225 rpm. The CPU 11 then returns the processing to Step S5 and terminates the one-cycle circulation operation (Step S5). The CPU 11 resets the elapsed time T to zero (Step S11) and returns the processing to Step S1.

Six-Cycle Circulation Operation According to Humidity

Figure 11:
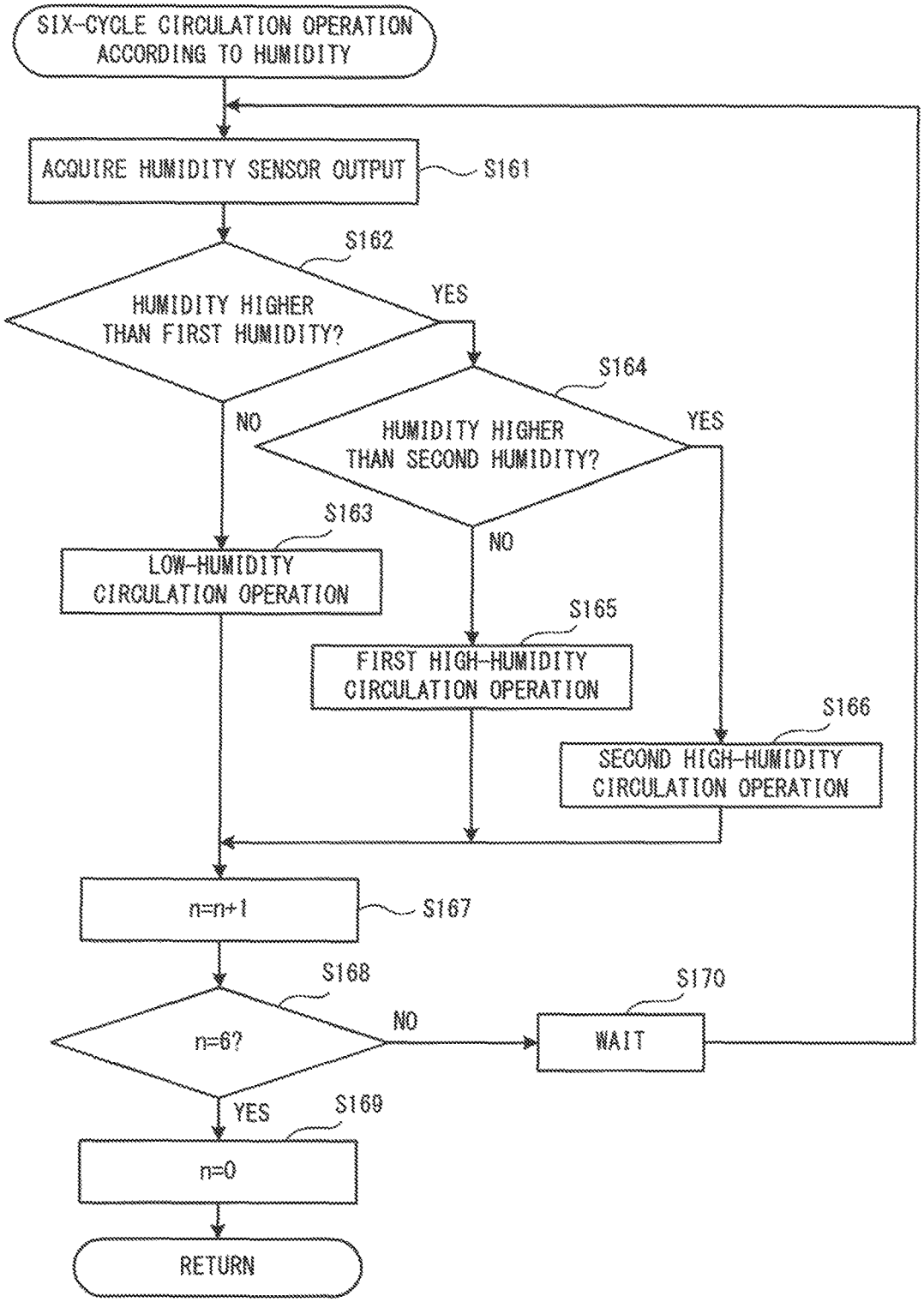
FIG. 11 is a flowchart of a six-cycle circulation operation according to humidity.

In the flowchart for the six-cycle circulation operation that is shown in FIG. 9, the CPU 11 uses the temperature as the standard for choosing from among the low-temperature circulation operation, the first high-temperature circulation operation, and the second high-temperature circulation operation. The CPU 11 may also perform the six-cycle circulation operation (Step S7) in accordance with the flowchart that is shown in FIG. 11 for the six-cycle circulation operation according to the humidity. The six-cycle circulation operation according to the humidity is an operation in which the one-cycle circulation operation according to the humidity is performed six times in succession. The processing at Steps S161 to S166 in the six-cycle circulation operation according to humidity flowchart that is shown in FIG. 11 is the same as the processing at Steps S141 to S146 in the one-cycle circulation operation according to the humidity flowchart that is shown in FIG. 10, so an explanation of that processing will be omitted. In the flowchart for the six-cycle circulation operation according to the humidity, each time the CPU 11 performs one of the low-humidity circulation operation (Step S163), the first high-humidity circulation operation (Step S165), and the second high-humidity circulation operation (Step S166), the CPU 11 increments by 1 the value of the counter n, which counts the number of times the circulation operation has been performed (Step S167). Next, the CPU 11 determines whether the counter n is equal to 6 (Step S168). When the CPU 11 determines that the counter n is not equal to 6 (NO at Step S168), it waits (Step S170) for five seconds, for example, then returns the processing to Step S161. When the CPU 11 determines that the counter n is equal to 6 (YES at Step S168), it resets the counter n to zero (Step S169), then returns the processing to Step S7 and terminates the six-cycle circulation operation (Step S7). The CPU 11 resets the elapsed time T to zero (Step S11), then returns the processing to Step S1. The eight-cycle circulation operation according to the humidity and the ten-cycle circulation operation according to the humidity are performed in the same manner as described above.

In at least one of the one-cycle circulation operation (Step S5) and the six-cycle circulation operation (Step S7), when the humidity that is based on the input value from the humidity sensor 25 is higher than the first humidity (YES at Step S142; YES at Step S162), the CPU 11 performs one of the first high-humidity circulation operation (Steps S145, S165) and the second high-humidity circulation operation (Steps S146, S166). When the humidity that is based on the input value from the humidity sensor 25 is not higher than the first humidity (NO at Step S142; NO at Step S162), the CPU 11 performs the low-humidity circulation operation (Steps S143, S163). The low-humidity circulation operation is an operation that uses at least one of a longer circulation time and a slower rotation speed for the pumps 901 to 904 than is used in the high-humidity circulation operations. When the circulation flow paths are not open to the atmosphere, the pressure within the circulation flow paths tends to become less than the atmospheric pressure, which makes it more difficult to maintain the meniscus that forms in the nozzle 113. The pressure within the circulation flow paths is proportional to the viscosity of the ink, and the viscosity is inversely proportional to the humidity. Therefore, if the humidity decreases, the circulation flow path pressure becomes greater, and the difference between the circulation flow path pressure and the atmospheric pressure becomes greater, making it more difficult to maintain the meniscus. The circulation flow path pressure becomes greater if the rotation speed of the pumps 901 to 904 increases. The difference between the circulation flow path pressure and the atmospheric pressure therefore becomes greater, and it becomes more difficult to maintain the meniscus. If the meniscus cannot be maintained, problems occur in the discharge of the ink from the nozzle 113. Therefore, when the humidity is low, if the rotation speed of the pumps 901 to 904 is made slower than it is in the high-humidity circulation operations, the circulation operation also becomes slower, and the circulation time becomes longer. However, the pressure of the ink that bears on the head 110 decreases, so the possibility that the meniscuses in the nozzles 113 will be destroyed can be reduced.

In at least one of the one-cycle circulation operation (Step S5) and the six-cycle circulation operation (Step S7), when the humidity that is based on the input value from the humidity sensor 25 is not greater than 20%, the CPU 11 performs the low-humidity circulation operation by operating the pumps 901 to 904 at a rotation speed not greater than 179 rpm. Based on the test results that are shown in Table 2, 179 rpm is the maximum rotation speed of the pumps 901 to 904 when the humidity is not greater than 20%. Therefore, missing image elements can be prevented from occurring in the printing, and the operation time of the low-humidity circulation operation can be shortened.

The present invention is not limited to the embodiment that is described above, and various types of modifications can be made within the scope of the present invention. For example, the circulation portion may also use elements other than the pumps 901 to 904. For example, a piezoelectric actuator or the like may be provided that regulates pressure such that a difference in pressure is created between two separate points in the first supply flow paths 711 to 714 and the circulation flow paths 731 to 734. The circulation operation may also be performed by applying pressure to the ink by using a piezoelectric actuator or the like to press on ink-containing pouches within the cartridges 311, 312. The temperature sensor 23 is not limited to being a thermistor, and it may also be a different temperature detection element. The cartridge sensors 24 are not limited to being optical sensors, and they may also be micro-switches that detect contact.

The fixed time T0, the first time T1, the second time T2, and the third time T3 are not limited to being the times mentioned in the embodiment that is described above, and they may be set as desired to match the characteristics and the installation environment of the printer 1. The rotation speed of the pumps 901 to 904 is not limited to the rotation speeds mentioned in the embodiment that is described above, and it may also be set as desired to match the characteristics and the installation environment of the pumps 901 to 904. The wait time at Steps S70 and S170 is not limited to five seconds, and it may be set as desired to ten seconds or the like. It is also acceptable not to provide a wait time at Steps S70 and S170. The second circulation operation repeats the one-cycle circulation operation six times, but it is not necessarily limited to six cycles. The number of cycles may be set as desired to match the characteristics and the installation environment of the printer 1. The third circulation operation repeats the one-cycle circulation operation one of eight times and ten times, but it is not necessarily limited to eight or ten cycles. The number of cycles may be set as desired to match the characteristics and the installation environment of the printer 1. The first temperature in the determination processing at Steps S42 and S62 is not limited to being 10° C. The first temperature may be set as desired to match the characteristics and the installation environment of the printer 1. For example, the first temperature may also be 18° C. or the like. A Cancel icon may be displayed on the screen 50A that displays the remaining time and is displayed on the display 50, such that the circulation operation can be canceled. The rotation speed of the pumps 901 to 904 that generates the circulation velocity Vc needs only to be not greater than 225 rpm. Preferably, the rotation speed should be 179 rpm. The rotation speed of the pumps 901 to 904 that generates the circulation velocity Vb needs only to be not greater than 302 rpm. The rotation speed of the pumps 901 to 904 may also be in the range from 100 rpm to 302 rpm.

In the embodiment that is described above, the printer 1 performs the white ink circulation operation in the ink flow path system 700. The printer 1 may also circulate the color inks by providing the second flow paths 721 to 724 with the same sort of structural elements as the structural elements that circulate the white ink (the branching portions 753A, 753B, the connecting flow paths 702A, 703A, 702B, 703B, the circulation flow paths 731 to 734, and the pumps 901 to 904). In that case, structural elements that are equivalent to the filter portions 681 to 688 may also be provided in the second flow paths 721 to 724.

The liquid that is discharged from the head units 100, 200 is not limited to being an ink, and it may also be a discharge agent that removes color from a dyed cloth. One end of each of the circulation flow paths 731 to 734 may also be connected to the cartridges 311, 312. The other ends of the circulation flow paths 731 to 734 may be connected to the heads 110. Specifically, the other ends of the circulation flow paths 731 to 734 may be connected to the connection portions 761A to 764A, respectively. In that case, the circulation of the ink can also be conducted inside the heads 110. However, it is thought that circulation outside the heads 110 has less effect on the meniscuses.

In the embodiment that is described above, examples are given in which the fixed time T0 is one hour and the first time T1 is 1.5 hours but the times are not necessarily limited to those examples. For example, the fixed time T0 may be seven hours, and the first time T1 may be 7.5 hours. In that case, when the CPU 11 does not determine that the elapsed time T is not less than the first time T1 (NO at Step S4), it may perform a three-cycle circulation operation instead of the one-cycle circulation operation (Step S5). The three-cycle circulation operation is an operation in which the one-cycle circulation operation is performed three times in succession. It is also acceptable for the CPU 11 not to display the remaining time as shown in FIG. 12A.

The pumps 901 to 904, which are examples of the circulation portion, are pumps that can be operated at a low rotation speed and a high rotation speed. The CPU 11, which is an example of the control portion, performs at least one of the one-cycle circulation operation (Step S5) and the six-cycle circulation operation (Step S7) by operating the pumps 901 to 904 at the low rotation speed. Therefore, if the rotation speed of the pumps 901 to 904 becomes slower, the circulation operation also becomes slower, and the circulation time becomes longer. However, the pressure of the ink that bears on the head unit 100 decreases, so the possibility that the meniscuses in the nozzles 113 will be destroyed can be reduced.

When the white ink is initially drawn in, the CPU 11 supplies the white ink from the cartridges 311, 312 to the head units 100, 200 through the first supply flow paths 711 to 714. At that time, in order to supply the white ink to the circulation flow paths 731 to 734 as well, the CPU 11 operates the pumps 901 to 904 at a lower rotation speed, 100 rpm, than the low rotation speed of 155 rpm that was given as a example. It is therefore possible to generate less waste ink when the white ink is initially drawn in than would be the case if the pumps 901 to 904 were operated at a rotation speed greater than 155 rpm. Furthermore, the first supply flow paths 711 to 714 and the circulation flow paths 731 to 734 can be filled with the white ink more reliably. That is, the CPU 11 operates the pumps 901 to 904 at a different rotation speed when the white ink is initially drawn in than it does during the circulation operation.

The CPU 11, which is an example of the control portion, performs at least one of the one-cycle circulation operation (Step S5) and the six-cycle circulation operation (Step S7) by operating the pumps 901 to 904 in the range of 155 rpm to 302 rpm as the low rotation speed. Therefore, the concern that fluctuations in the pressure of the ink will destroy the meniscuses in the nozzles 113 of the head 110 can be reduced, even in a state in which the first supply flow paths 711 to 714 and the circulation flow paths 731 to 734 are not open to the atmosphere.

When the temperature that is based on the input value from the temperature sensor 23, which is an example of the temperature detection portion, is not higher than 10° C., the CPU 11, which is an example of the control portion, performs the low-temperature circulation operation (Steps S43, S63) as the at least one of the one-cycle circulation operation (Step S5) and the six-cycle circulation operation (Step S7) by operating the pumps 901 to 904 at a rotation speed not greater than 179 rpm. Therefore, when the temperature is not higher than 10° C., performing the circulation operation with the rotation speed of the pumps 901 to 904 not greater than 179 rpm makes it possible to shorten the operation time of the low-temperature circulation operation while also preventing any missing image elements from occurring in the printing.

When the humidity that is based on the input value from the humidity sensor 25, which is an example of the humidity detection portion, is not higher than 20%, the CPU 11, which is an example of the control portion, performs the low-humidity circulation operation (Steps S143, S163) as the at least one of the one-cycle circulation operation (Step S5) and the six-cycle circulation operation (Step S7) by operating the pumps 901 to 904 at a rotation speed not greater than 179 rpm. Therefore, when the humidity is not higher than 20%, performing the circulation operation with the rotation speed of the pumps 901 to 904 not greater than 179 rpm makes it possible to shorten the operation time of the low-humidity circulation operation while also preventing any missing image elements from occurring in the printing.

The second circulation processing is not limited to the performing of the second circulation operation (Step S7), for which the operation time is longer than for the first circulation operation (Step S5). The CPU 11, which is an example of the control portion, performs the second circulation processing by operating the pumps 901 to 904, which are examples of the circulation portion, at a high rotation speed. The operation time does not become longer, but the ink, which is an example of a liquid, may be agitated more than it would be by the first circulation operation (Step S5).

When the elapsed time T is not less than the fixed time T0 (YES at Step S3) and is less than the first time T1 (NO at Step S4), the CPU 11, which is an example of the control portion, performs the first circulation operation (Step S5). Further, when the elapsed time T is not less than the first time T1 (YES at Step S4) and is less than the second time T2 (NO at Step S6), the CPU 11 performs the second circulation operation (Step S7). When the elapsed time T is not less than the second time T2 (YES at Step S6), the CPU 11 performs the third circulation operation (Step S7 or Step S9). However, it is not necessary to perform all of the first circulation operation, the second circulation operation, and the third circulation operation, and it is also acceptable to perform only one or two of the circulation operations.

Note that a microcomputer, an application specific integrated circuit (ASIC), a field programmable gate array (FPGA), or the like may also be used as a processor, instead of the CPU 11. The first circulation processing and the second circulation processing may also be performed by distributed processing among a plurality of processors.

A non-transitory computer readable medium needs only to be a storage medium that is capable of storing information irrespective of the period for which the information is stored. For example, the ROM 12 may be replaced by another non-transitory storage medium, such as a flash memory, a hard disk drive, or the like. The non-transitory storage medium is not required to include a temporary storage medium (for example, a transmitted signal). The control program may also be downloaded (that is, transmitted as a signal) from a server that is connected to a network that is not shown in the drawings, for example, and may be stored in a flash memory, a hard disk drive, or the like. In that case, the control program needs only to be stored in a non-transitory storage medium, such as a hard disk drive or the like.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a head provided with a nozzle configured to discharge a liquid;

a storage portion configured to store the liquid;

a supply flow path connected to the head and the storage portion and configured to supply the liquid to the head from the storage portion;

a circulation flow path, one end of the circulation flow path being connected to one of the storage portion and the supply flow path at a first connection portion, the other end of the circulation flow path being connected to one of the head and the supply flow path at a second connection portion, the position of the second connection portion in the supply flow path being closer to the head than is the position of the first connection portion in the supply flow path;

a circulation portion configured to circulate the liquid through the supply flow path and the circulation flow path;

a processor; and a memory storing computer readable instructions that, when executed by the processor, perform processes including first determination processing that determines whether a first time has elapsed since a circulation operation was last performed, first circulation processing that circulates the liquid by a first circulation operation in a sealed state when the first determination processing has determined that the first time has not elapsed, the sealed state being a state in which the supply flow path and the circulation flow path are not open to the atmosphere, and second circulation processing that agitates the liquid by a second circulation operation in the sealed state when the first determination processing has determined that the first time has elapsed, the second circulation operation agitating the liquid more than does the first circulation operation.

2. The print device according to claim 1, wherein the processor performs the second circulation processing to perform the second circulation operation with a longer operation time than the operation time for the first circulation operation.

3. The print device according to claim 1, further comprising:

a temperature detection portion configured to detect a temperature, wherein the circulation portion is a pump, the processor performs, as at least one of the first circulation operation and the second circulation operation, a high-temperature circulation operation when a temperature based on an input value from the temperature detection portion is higher than a first temperature, and the processor performs, as at least one of the first circulation operation and the second circulation operation, a low-temperature circulation operation when the temperature based on the input value from the temperature detection portion is not higher than the first temperature, the low-temperature circulation operation including at least one of a condition that a circulation time is longer than in the high-temperature circulation operation and a condition that a rotation speed of the pump is slower than in the high-temperature circulation operation is satisfied.

4. The print device according to claim 1, wherein the processor performs second determination processing that determines whether a second time has elapsed when the first determination processing has determined that the first time has elapsed, the second time being longer than the first time, the second circulation processing that performs the second circulation operation when the second determination processing has determined that the second time has not elapsed, and third circulation processing that agitates the liquid more than does the second circulation operation by a third circulation operation when the second determination processing has determined that the second time has elapsed.

5. The print device according to claim 4, further comprising:

a display portion configured to display a remaining time for the circulation of the liquid by the circulation portion, wherein the processor does not display the remaining time during the first circulation operation and displays the remaining time during the second circulation operation and the third circulation operation.

6. The print device according to claim 1, wherein the processor performs fixed time determination processing that determines whether a fixed time has elapsed since a circulation operation was last performed, the fixed time being shorter than the first time, the processor does not perform the first circulation operation and the second circulation operation when the fixed time determination processing has determined that the fixed time has not elapsed, and the processor performs one of the first circulation operation and the second circulation operation, based on the result of the first determination processing, when the fixed time determination processing has determined that the fixed time has elapsed.

7. The print device according to claim 1, further comprising:

a sensor configured to output a mounting signal, the mounting signal indicating that the storage portion has been mounted, wherein the processor, in the first circulation processing and the second circulation processing, performs the first circulation operation and the second circulation operation in a state in which the mounting signal has been input from the sensor.

8. The print device according to claim 1, further comprising:

a humidity detection portion configured to detect humidity, wherein the processor performs, as at least one of the first circulation operation and the second circulation operation, a high-humidity circulation operation when a humidity based on an input value from the humidity detection portion is higher than a first humidity, and the processor performs, as at least one of the first circulation operation and the second circulation operation, a low-humidity circulation operation when the humidity based on the input value from the humidity detection portion is not higher than the first humidity, the low-humidity circulation operation including at least one of a condition that the circulation time is longer than in the high-humidity circulation operation and a condition that a rotation speed of the circulation portion is slower than in the high-humidity circulation operation is satisfied.

9. A print device comprising:

a head provided with a nozzle configured to discharge a liquid;

a storage portion configured to store the liquid;

a supply flow path connected to the head and the storage portion and configured to supply the liquid to the head from the storage portion;

a circulation flow path, one end of the circulation flow path being connected to one of the storage portion and the supply flow path at a first connection portion, the other end of the circulation flow path being connected to one of the head and the supply flow path at a second connection portion, the position of the second connection portion in the supply flow path being closer to the head than is the position of the first connection portion in the supply flow path;

a circulation portion configured to circulate the liquid through the supply flow path and the circulation flow path;

a processor; and a memory storing computer readable instructions that, when executed by the processor, perform processes including first acquisition processing that acquires an elapsed time since a circulation operation was last performed, second acquisition processing that acquires an operation time for the circulation portion in accordance with the elapsed time that was acquired by the first acquisition processing, and operation processing that operates the circulation portion in a sealed state for the operation time that was acquired by the second acquisition processing, the sealed state being a state in which the supply flow path and the circulation flow path are not open to the atmosphere.

10. A non-transitory computer readable medium storing computer readable instructions that, when executed by a processor of a print device provided with:

a head provided with a nozzle configured to discharge a liquid, a storage portion configured to store the liquid, a supply flow path connected to the head and the storage portion and configured to supply the liquid to the head from the storage portion, a circulation flow path, one end of the circulation flow path being connected to one of the storage portion and the supply flow path at a first connection portion, the other end of the circulation flow path being connected to one of the head and the supply flow path at a second connection portion, the position of the second connection portion in the supply flow path being closer to the head than is the position of the first connection portion in the supply flow path, a circulation portion configured to circulate the liquid through the supply flow path and the circulation flow path, and the processor configured to control the circulation portion, perform processes including first determination processing that determines whether a first time has elapsed since a circulation operation was last performed, first circulation processing that circulates the liquid by a first circulation operation in a sealed state when the first determination processing has determined that the first time has not elapsed, the sealed state being a state in which the supply flow path and the circulation flow path are not open to the atmosphere, and second circulation processing that agitates the liquid by a second circulation operation in the sealed state when the first determination processing has determined that the first time has elapsed, the second circulation operation agitating the liquid more than does the first circulation operation.

* * * * *